US012252366B2

(12) United States Patent
Murase et al.

(10) Patent No.: US 12,252,366 B2
(45) Date of Patent: Mar. 18, 2025

(54) DOCUMENT RECEIVING APPARATUS

(71) Applicant: CANON DENSHI KABUSHIKI KAISHA, Chichibu (JP)

(72) Inventors: Asako Murase, Nagareyama (JP); Masashi Yamaguchi, Kawasaki (JP); Shigeru Ikezaki, Tokyo (JP)

(73) Assignee: CANON DENSHI KABUSHIKI KAISHA, Chichibu (JP)

( * ) Notice: Subject to any disclaimer, the term of this patent is extended or adjusted under 35 U.S.C. 154(b) by 177 days.

(21) Appl. No.: 17/899,044

(22) Filed: Aug. 30, 2022

(65) Prior Publication Data

US 2023/0123779 A1 Apr. 20, 2023

(30) Foreign Application Priority Data

Aug. 31, 2021 (JP) ..... 2021-141609
Aug. 31, 2021 (JP) ..... 2021-141618

(51) Int. Cl.

| | |
|---|---|
| ***B65H 3/06*** | (2006.01) |
| ***B65H 3/34*** | (2006.01) |
| ***B65H 3/54*** | (2006.01) |
| ***B65H 5/06*** | (2006.01) |
| ***B65H 5/20*** | (2006.01) |

(Continued)

(52) U.S. Cl.

CPC ..... *B65H 3/063* (2013.01); *B65H 3/06* (2013.01); *B65H 3/0653* (2013.01); *B65H 3/34* (2013.01); *B65H 3/54* (2013.01); *B65H 5/062* (2013.01); *B65H 5/20* (2013.01); *B65H 5/36* (2013.01); *B65H 7/20* (2013.01); *B65H 2404/152* (2013.01)

(58) Field of Classification Search

CPC ..... B65H 1/04; B65H 1/06; B65H 3/0661; B65H 3/063; B65H 3/0653; B65H 3/34; B65H 3/54; B65H 9/004

See application file for complete search history.

(56) References Cited

U.S. PATENT DOCUMENTS

| | | | |
|---|---|---|---|
| 7,621,522 | B2 | 11/2009 | Yasukawa et al. |
| 9,181,050 | B2 | 11/2015 | Machida et al. |
| 9,592,974 | B2 | 3/2017 | Saito et al. |

(Continued)

FOREIGN PATENT DOCUMENTS

| | | | |
|---|---|---|---|
| JP | 2-261739 | A | 10/1990 |
| JP | 11-334919 | A | 12/1999 |

(Continued)

OTHER PUBLICATIONS

Office Action dated Apr. 15, 2024, in Japanese Patent Application No. 2021-141609.

(Continued)

*Primary Examiner* — Prasad V Gokhale
(74) *Attorney, Agent, or Firm* — Venable LLP

(57) ABSTRACT

A document receiving apparatus comprises a receiving port configured to receive a document into an apparatus main body, a document stopper configured to be pivotable between a first posture in which reception of the document is suppressed and a second posture in which the reception is permitted, a holding portion configured to hold the document stopper in the first posture, and a biasing portion configured to bias the document stopper held in the first posture to be set in the second posture.

17 Claims, 18 Drawing Sheets

(51) Int. Cl.
*B65H 5/36* (2006.01)
*B65H 7/20* (2006.01)

(56) References Cited

U.S. PATENT DOCUMENTS

| | | | | |
|---|---|---|---|---|
| 10,246,281 | B2 | 4/2019 | Kuriki | |
| 10,625,965 | B2 | 4/2020 | Kuriki | |
| 2008/0203652 | A1* | 8/2008 | Yasukawa | B65H 3/063 271/117 |
| 2020/0165086 | A1* | 5/2020 | Zaitsu | B65H 5/26 |

FOREIGN PATENT DOCUMENTS

| | | | | |
|---|---|---|---|---|
| JP | 2008-207944 | A | | 9/2008 |
| JP | 2012-101892 | A | | 5/2012 |
| JP | 2012-101905 | A | | 5/2012 |
| JP | 2015160688 | A | * | 9/2015 |
| JP | 2016-069157 | A | | 5/2016 |
| JP | 2018-070320 | A | | 5/2018 |
| JP | 2019-026425 | A | | 2/2019 |

OTHER PUBLICATIONS

Office Action dated Apr. 15, 2024, in Japanese Patent Application No. 2021-141618.

* cited by examiner

DOCUMENT RECEIVING APPARATUS

BACKGROUND OF THE INVENTION

Field of the Invention

The present invention mainly relates to a document receiving apparatus.

Description of the Related Art

Some document receiving apparatuses each of which can be mounted on a printer, a scanner, or the like are provided with a rotary stopper to control permission of reception of a document into an apparatus main body and suppression of the reception (see Japanese Patent Laid-Open No. 2008-207944).

In general, a relatively simple arrangement for appropriately receiving a document into an apparatus main body is required. From this viewpoint, there is room for improvement of the arrangement described in Japanese Patent Laid-Open No. 2008-207944.

SUMMARY OF THE INVENTION

It is an exemplary object of the present invention to appropriately receive a document into an apparatus main body by a relatively simple arrangement.

One aspect of the present invention relates to a document receiving apparatus, and the document receiving apparatus comprises a receiving port configured to receive a document into an apparatus main body, a document stopper configured to pivot between a first posture in which reception of the document is suppressed and a second posture in which the reception is permitted, a holding portion configured to hold the document stopper in the first posture, and a biasing portion configured to bias the document stopper held in the first posture to be set in the second posture.

Another aspect of the present invention relates to a document receiving apparatus, and the document receiving apparatus comprises a receiving port configured to receive a document into an apparatus main body from a stack tray on which a plurality of documents can be stacked, a document stopper configured to be pivotable between a first posture in which reception of the document is suppressed and a second posture in which the reception is permitted, and a control unit configured to set the document stopper from the first posture to the second posture and receive the document from the receiving port, wherein the control unit brings downstream end portions of the plurality of documents into contact with the document stopper in an intermediate posture between the first posture and the second posture.

According to the present invention, it is possible to appropriately receive a document into an apparatus main body.

Further features of the present invention will become apparent from the following description of exemplary embodiments (with reference to the attached drawings).

DESCRIPTION OF THE EMBODIMENTS

Figure 1:
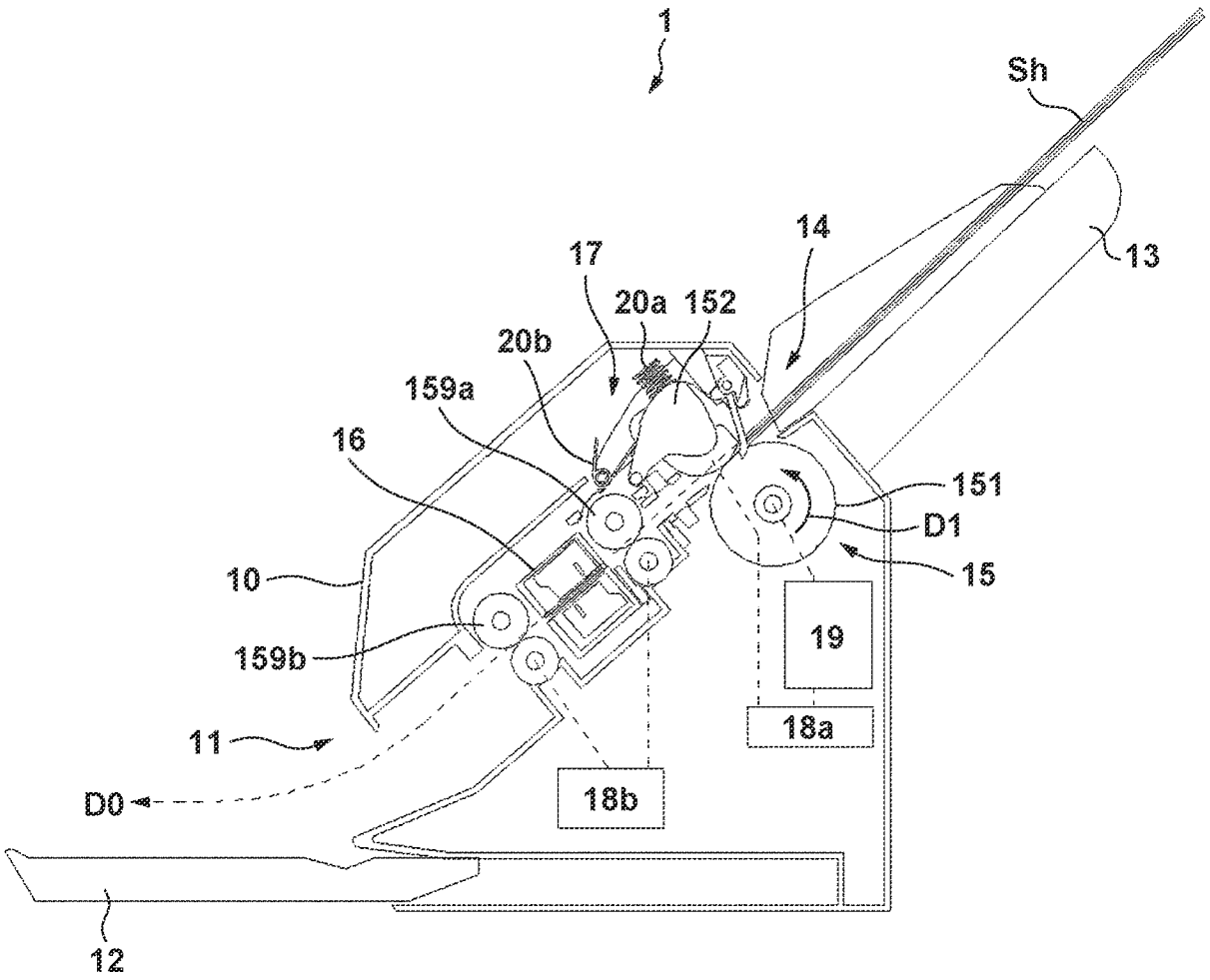
FIG. 1 is a view showing an example of the arrangement of an image reading apparatus.

Hereinafter, embodiments will be described in detail with reference to the attached drawings. Note, the following embodiments are not intended to limit the scope of the claimed invention, and limitation is not made to an invention that requires a combination of all features described in the embodiments. Two or more of the multiple features described in the embodiments may be combined as appropriate. Furthermore, the same reference numerals are given to the same or similar configurations, and redundant description thereof is omitted.

First Embodiment

FIG. 1 shows an example of the arrangement of an image reading apparatus 1 according to the first embodiment. Although details will be described later, the image reading apparatus 1 receives a document Sh as an image reading target into an apparatus main body (a housing 10), and reads an image of the received document Sh. After the completion of the image reading, the document Sh is discharged from a discharge port 11 onto a discharge tray 12. If there are two or more documents Sh, they are stacked on the discharge tray 12.

Assume that the document Sh is a sheet-like member (typically, a paper material or the like), and images are formed on one surface and the other surface of the document Sh. The concept of an image includes not only a recognizable image such as a character, a symbol, a graphic, and a photo but also a space that can be formed on the periphery of the image or between the images.

This embodiment assumes that the image reading apparatus 1 has a scanner function. However, as another embodiment, the image reading apparatus 1 may additionally/alternatively have another function. From this viewpoint, the image reading apparatus 1 may be expressed as a document receiving apparatus, a document feeding apparatus, a feeding apparatus, a sheet feeding apparatus, or the like.

In addition to the discharge tray 12, the image reading apparatus 1 includes a stack tray 13, a receiving port 14, a conveyance mechanism 15, a reading unit 16, a document receiving mechanism 17, power sources 18*a* and 18*b*, and a power transmission mechanism 19.

On the stack tray 13, the document Sh can be placed and, if there are two or more documents Sh, they can be stacked. The stack tray 13 may be expressed as a stack portion or the like but can be expressed as a sheet feeding tray, a feeding portion, or the like if the document Sh is made of a sheet material. The stack tray 13 is preferably extended to be tilted so that one end portion on the side of the apparatus main body is set on the lower side and the other end portion is set on the upper side.

The receiving port 14 is a portion where an opening for receiving the document Sh from the stack tray 13 into the apparatus main body is formed, and is formed in a frame shape by one or more members constituting the housing 10.

Figure 2:
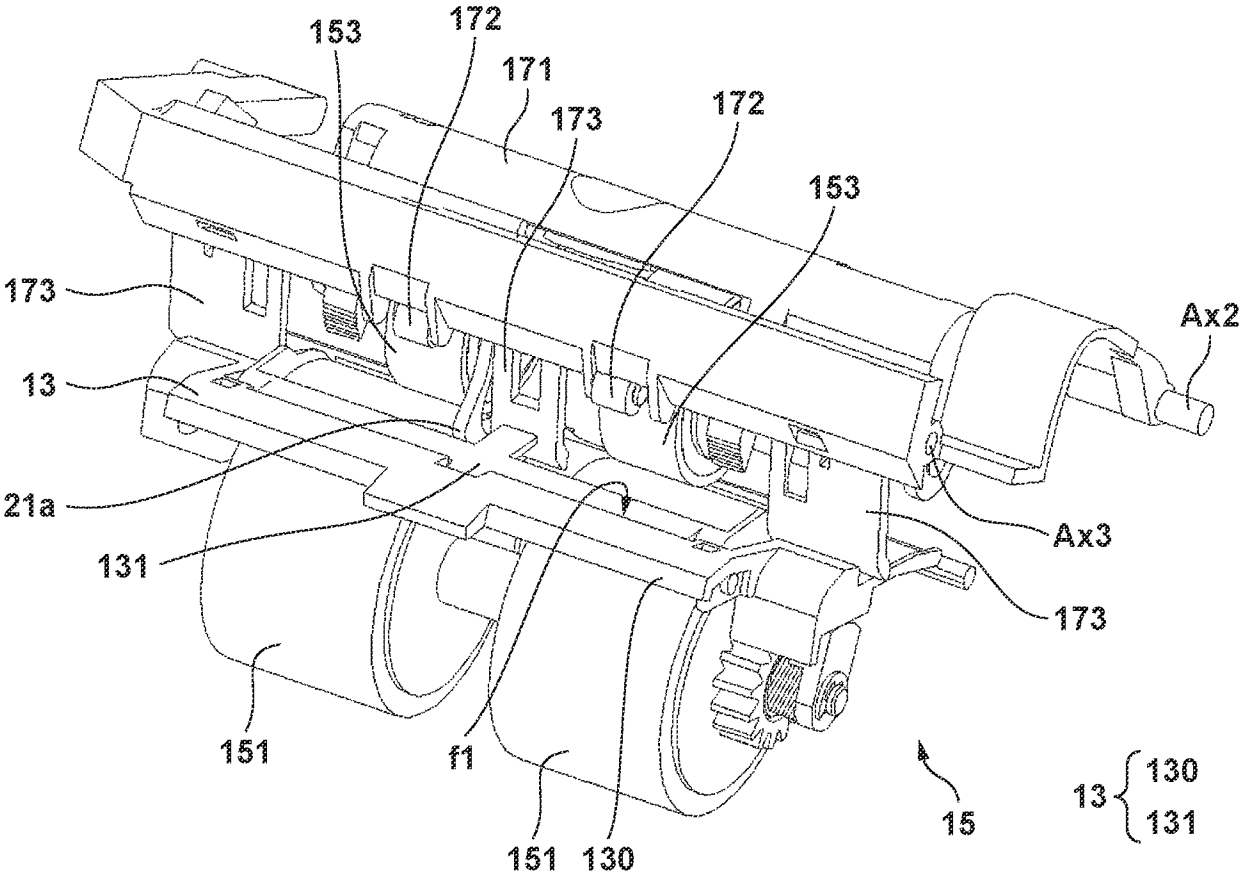
FIG. 2 is a perspective view of the image reading apparatus.
Figure 3:
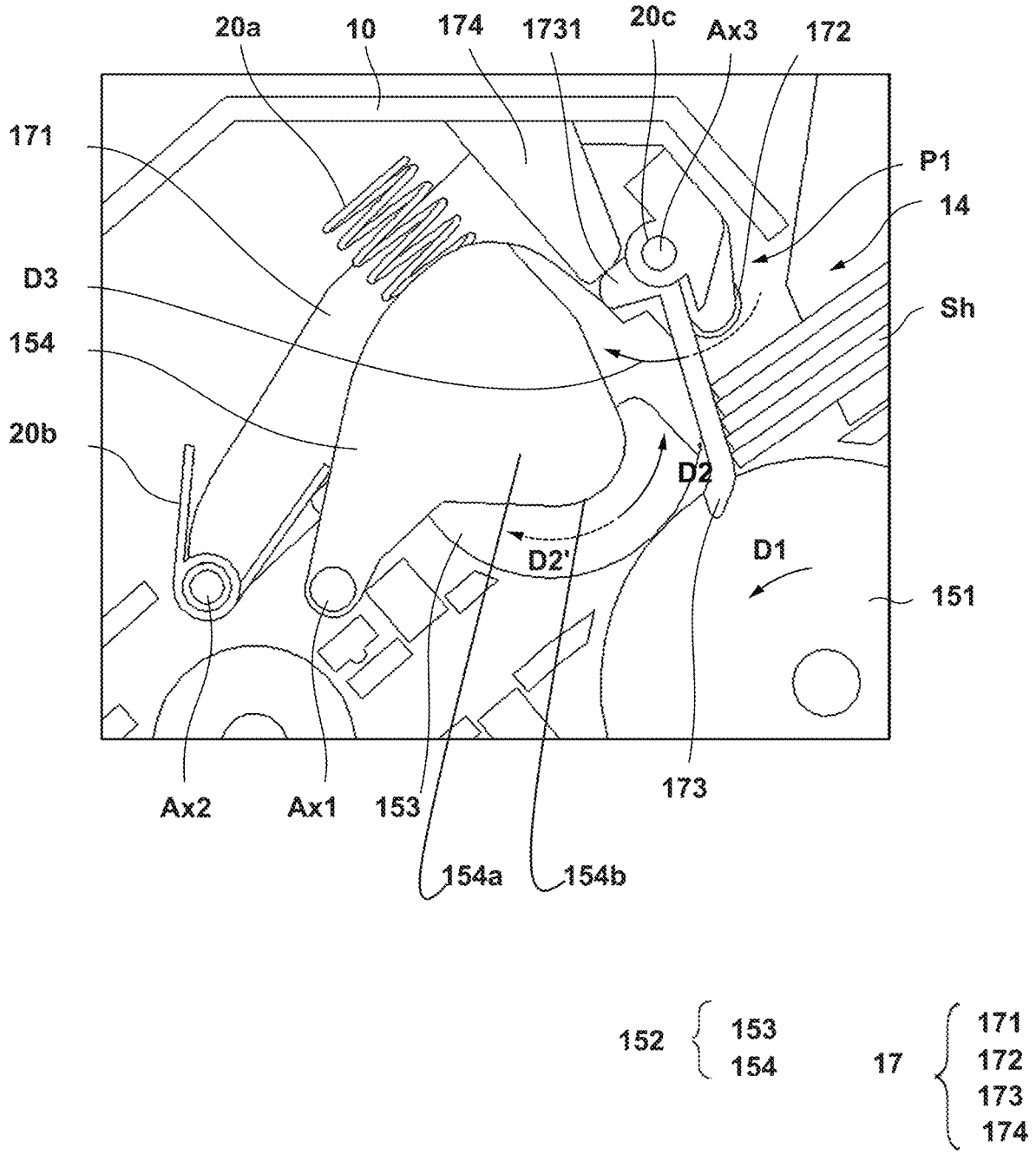
FIG. 3 is an enlarged schematic view showing the internal structure of a receiving port and its peripheral portion.
Figure 4:
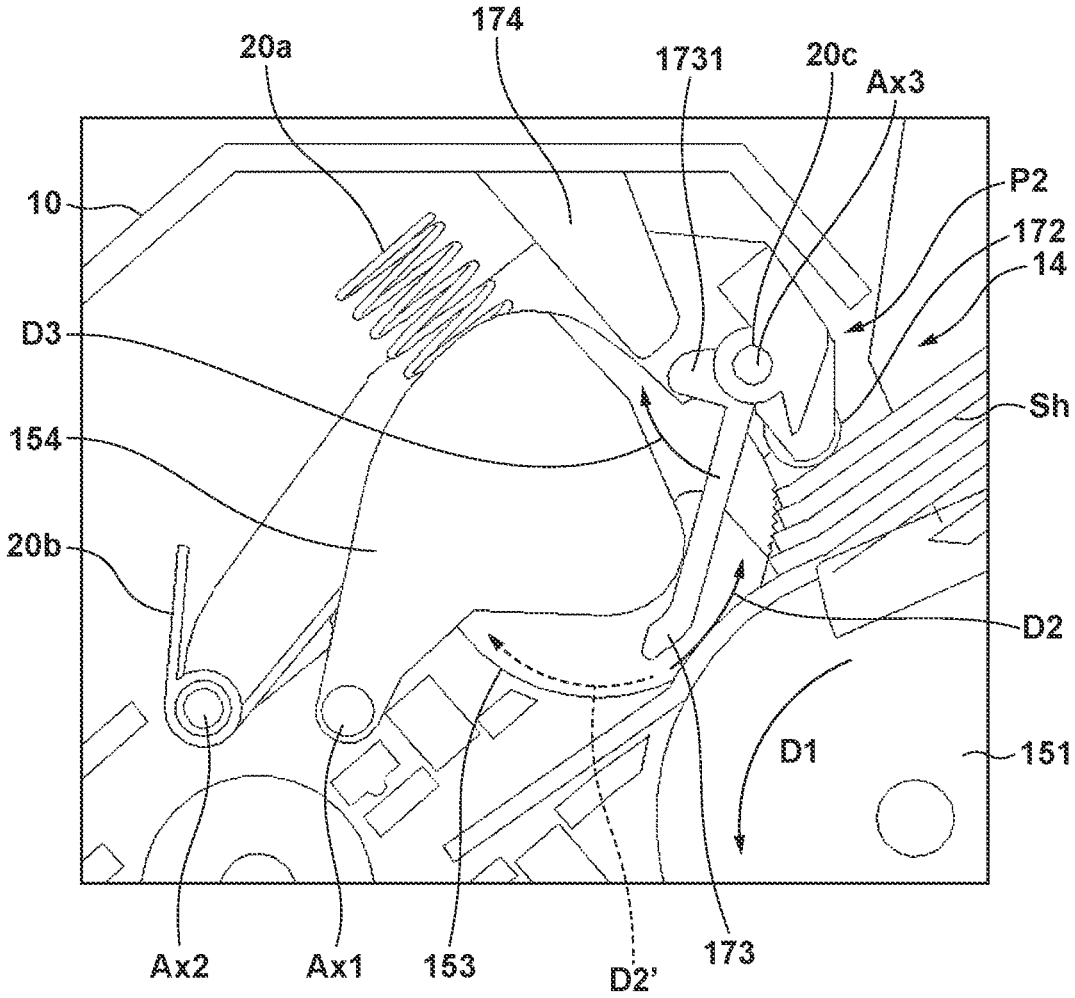
FIG. 4 is an enlarged schematic view showing the internal structure of the receiving port and its peripheral portion.
Figure 5:
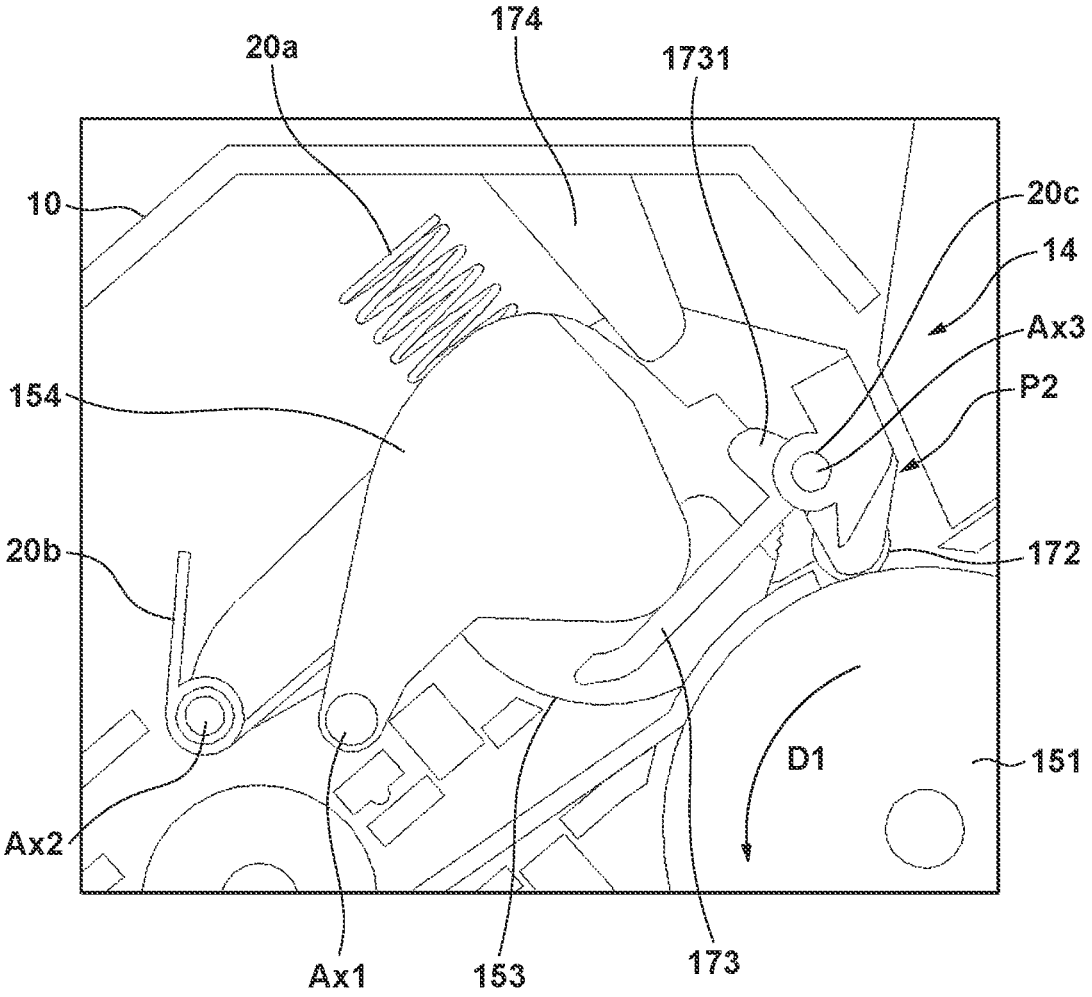
FIG. 5 is an enlarged schematic view showing the internal structure of the receiving port and its peripheral portion.

FIG. 2 is a perspective view of the image reading apparatus 1 when viewed from the side of the receiving port 14. FIGS. 3 to 5 are enlarged schematic views each showing the internal structure of the receiving port 14 and its peripheral portion. The structure of the image reading apparatus 1 will be described in detail below with reference to FIGS. 2 to 5 in addition to FIG. 1.

As shown in FIG. 1, the conveyance mechanism 15 is configured to form a conveyance path of the document Sh from the stack tray 13 to the discharge tray 12, and includes feeding rollers 151, a separation unit 152, a roller pair (conveyance rollers) 159*a*, and a roller pair (discharge rollers) 159*b* in this embodiment. Note that in FIG. 1, the conveyance path of the document Sh is indicated by a broken line, and the conveyance direction is represented as a direction D0.

The feeding rollers 151 are driving rollers provided close to the receiving port 14, and rotate in a direction D1 by receiving the power of the power source 18*a* (to be described later) in this embodiment. Note that the feeding rollers 151 each include a one-way clutch, and rotate together with the document Sh when the document Sh moves at a speed higher than the peripheral speed of the feeding rollers 151 by the roller pair 159*a* and the like.

The separation unit 152 shown in FIG. 1 incudes separation rollers 153 and holder members 154 (see FIG. 3). The separation rollers 153 can sandwich, with the feeding rollers 151, the document Sh received from the receiving port 14. Each separation roller 153 incorporates a torque limiter, and can rotate in a direction D2 (see FIG. 3) by receiving the power of the power source 18*a* while rotating in a direction D2' if torque equal to or higher than a reference is applied from the feeding roller 151 or the document Sh. Thus, if two or more documents Sh are received from the receiving port 14, among the two or more documents Sh, the document Sh on the side of the separation rollers 153 is returned from the receiving port 14 onto the stack tray 13 or is prevented from entering from the receiving port 14. That is, the documents Sh are received into the apparatus main body toward the downstream side one by one, and are appropriately conveyed to the reading unit 16 (to be described later).

Note that the downstream side in this specification indicates the same direction as the conveyance direction D0. The opposite direction of the conveyance direction D0 is represented as the upstream side.

FIG. 2 is a perspective view of the image reading apparatus 1 when viewed from the side of the receiving port 14. Although details will be described later, FIGS. 3 to 5 are enlarged schematic views each showing the internal structure of the receiving port 14 and its peripheral portion.

The holder member 154 shown in FIG. 3 rotatably holds the separation roller 153. The separation unit 152 is fixed to the housing 10 to be pivotable about a shaft portion A×1, and is pressed by a biasing portion 20*a* toward the feeding roller 151. This brings the separation roller 153 into contact with the feeding roller 151, and can sandwich the document Sh together with the feeding roller 151.

Referring back to FIG. 1, the roller pair 159*a* can sandwich, by a driving roller and a driven roller, the document Sh during conveyance, is arranged on the upstream side of the reading unit 16, and is arranged between the feeding roller 151 and the reading unit 16 in this embodiment. The roller pair 159*b* can sandwich, by a driving roller and a driven roller, the document Sh during conveyance, is arranged on the downstream side of the reading unit 16, and is arranged between the discharge port 11 and the reading unit 16 in this embodiment. In this embodiment, the driving rollers of the roller pairs 159*a* and 159*b* are driven based on the power of the power source 18*b*.

The reading unit 16 is installed between the roller pairs 159*a* and 159*b* in the conveyance path of the document Sh. In this embodiment, a pair of reading units 16 is installed. One reading unit 16 reads an image on one surface of the document Sh, and the other reading unit 16 reads an image on the other surface of the document Sh. As the reading unit 16, any known image contact sensor can be used. For example, an image capturing apparatus formed by a CCD/CMOS image sensor is used.

Each of the enlarged schematic views of FIGS. 3 to 5 shows the driving mode of the document receiving mechanism 17 for reading the document Sh or suppressing the reading.

The document receiving mechanism 17 includes an arm portion 171, pressing portions 172, document stoppers 173, and a holding portion 174. The arm portion 171 is installed in the housing 10 to be pivotable about a shaft portion A×2, and is biased by a biasing portion 20*b* in a direction of moving close to the feeding rollers 151. The arm portion 171 receives the power of the power source 18*b* to be pivotable in a direction of moving away from the feeding rollers 151.

The pressing portions 172 are supported by the arm portion 171, and are located on the opposite side of the feeding rollers 151 with respect to the document Sh to be received. In this embodiment, a driven roller is used as each pressing portion 172. However, any roller can be used to slidably press the document Sh or press the document Sh following the movement of the document Sh. The arm portion 171 can pivot between a position P1 (see FIG. 3) as the first position at which the pressing portions 172 are separated from the document Sh and a position P2 (see FIG. 5) as the second position at which the pressing portion 172 presses the document Sh (see FIGS. 3 to 5), and the pressing portions 172 press the document Sh by the pivot of the arm portion 171.

The document stoppers 173 are supported by the arm portion 171 to be pivotable about a shaft portion A×3, and are biased by the biasing portion 20*c* to pivot in a direction D3.

While the arm portion 171 is located at the position P1, the holding portion 174 holds the document stoppers 173 to maintain the standing posture (see FIG. 3). In this embodiment, each document stopper 173 includes a lock portion 1731 locked in the holding portion 174, and is held in the standing posture by the lock portion 1731.

If the arm portion 171 pivots from the position P1 toward the position P2, holding of the document stoppers 173 by the holding portion 174 is canceled, and the document stoppers 173 are biased by the biasing portion 20*c* to pivot in the direction D3 and are switched from the standing posture to the tilting posture (see FIG. 4). After that, the arm portion 171 is maintained in the state in which it pivots to the position P2 while pressing the documents Sh by the pressing portions 172 until all the documents Sh on the stack tray 13 are received (see FIG. 5).

With this arrangement, the document stoppers 173 suppress reception of the document Sh in the standing posture (first posture), and permit reception of the document Sh in the tilting posture (second posture). Note that the holding portion 174 may be fixed to the upper portion of the housing 10 integrally or separately.

As shown in FIGS. 4 to 5, the document stopper 173 biased by the biasing portion 20*c* comes into contact with the holder member 154 to be locked. Therefore, the document stopper 173 is set in the tilting posture as the arm portion 171 moves away from the position P1. On the other hand, as shown in FIG. 3, the document stopper 173 is set in the standing posture as the arm portion 171 moves close to the position P1. If the arm portion 171 pivots to the position P1, the document stopper 173 is held by the holding portion 174 and maintained in the standing posture.

The power transmission mechanism 19 is configured to transmit the power of the power source 18*a* to the feeding rollers 151 in this embodiment (see FIG. 1). However, as another embodiment, the power transmission mechanism 19 may be configured to additionally/alternatively transmit the power to the arm portion 171. Therefore, the power transmission mechanism 19 is arranged in a path between the power source 18 and the arm portion 171 and/or the feeding rollers 151.

The timings of transmitting the power from the power source 18*a* to the feeding rollers 151 and the arm portion 171, respectively, can be adjusted. This may be implemented by controlling driving of the power transmission mechanism 19 or may be implemented additionally/alternatively by another element such as a clutch mechanism or a lock mechanism.

As the power sources 18*a* and 18*b*, known electric motors can be used. In this embodiment, the power source 18*a* corresponding to the feeding rollers 151 and the arm portion 171 and the power source 18*b* corresponding to the driving rollers of the roller pairs 159*a* and 159*b* are separately provided. However, as another embodiment, a single power source may be shared. Alternatively, as still another embodiment, a power source may be individually provided for each of the feeding rollers 151, the arm portion 171, the driving roller of the roller pair 159*a*, and the driving roller of the roller pair 159*b*.

As shown in FIG. 2, a feeding roller cover 130 is provided on the side of the conveyance path of the feeding rollers 151. A guide member 131 is provided in the feeding roller cover 130. The guide member 131 forms a placement surface f1 on which the document Sh (the downstream end portion in this embodiment) to be received into the receiving port 14 can be placed. In this embodiment, the guide member 131 is supported by the feeding roller cover 130 to be pivotable from a position (see FIG. 8) at which the placement surface f1 protrudes to the center side of the conveyance path with respect to the surfaces of the feeding rollers 151 to a position (see FIG. 10) at which the placement surface f1 is away from the center side of conveyance path with respect to the surfaces of the feeding rollers 151.

In this embodiment, the guide member 131 is biased by a biasing portion 20*d* (see FIG. 8) toward the center of the conveyance path and abuts against the abutment portion (not shown) on a side view (when viewed in the axial direction of the feeding roller 151). If the number of documents Sh is relatively small, the downstream end portions of the documents Sh are located on the center side (upper side) of the conveyance path with respect to the surfaces of the feeding rollers 151, and are directed between the feeding rollers 151 and the separation rollers 153. This can prevent a situation in which the documents Sh are caught by the feeding rollers 151 and thus cannot be set at a predetermined set position when placing the documents Sh on the stack tray 13 in the case of a small number of documents Sh. If the number of documents Sh is relatively large, the guide member 131 pivots by the weight, and the placement surface f1 is located in a direction (lower side) of moving away from the center of the conveyance path with respect to the feeding rollers 151. This allows the guide member 131 to guide the document Sh, when receiving the document Sh, so that the document Sh is appropriately received by coming into contact with the feeding rollers 151 while being pressed by the pressing portions 172.

Figure 6:
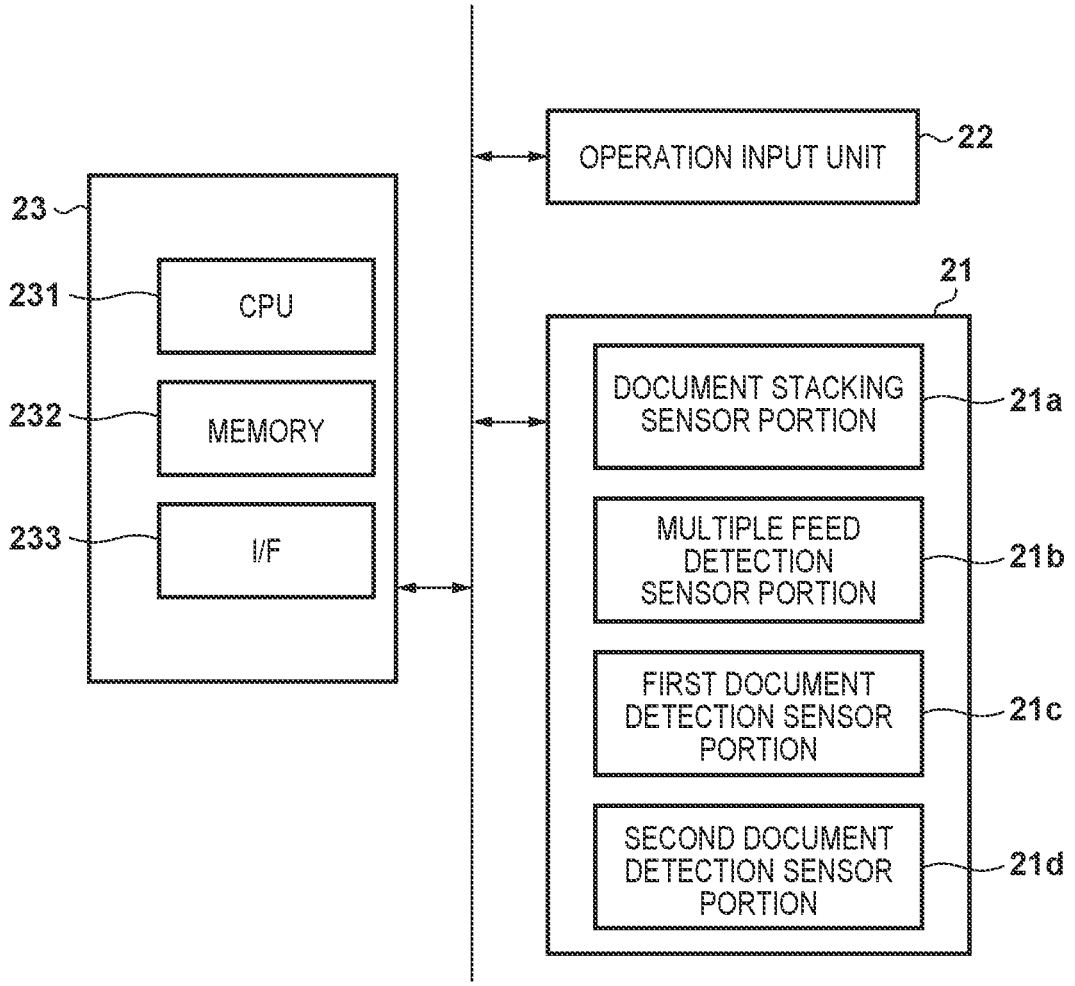
FIG. 6 is a block diagram showing the system arrangement of the image reading apparatus.

FIG. 6 is a block diagram showing the system arrangement of the image reading apparatus 1. The image reading apparatus 1 further includes a document stacking sensor portion 21*a*, a multiple feed detection sensor portion 21*b*, a first document detection sensor portion 21*c*, a second document detection sensor portion 21*d*, an operation input unit 22, and a control unit 23.

The document stacking sensor portion 21*a*, the multiple feed detection sensor portion 21*b*, the first document detection sensor portion 21*c*, and the second document detection sensor portion 21*d* can be installed at some positions in the conveyance path of the document Sh. FIG. 6 shows, as a sensor group 21, the document stacking sensor portion 21*a*, the multiple feed detection sensor portion 21*b*, the first document detection sensor portion 21*c*, and the second document detection sensor portion 21*d*. The document stacking sensor portion 21*a* is pivotably provided in the upper portion of the housing 10 to be aligned with the document stopper 173 in the left-and-right direction (the horizontal direction, a direction substantially orthogonal to the conveyance direction, and the widthwise direction of the apparatus) and to be located slightly on the upstream side of the document stopper 173 in the conveyance direction (see FIG. 2), pivots when coming into contact with the document Sh, and outputs a predetermined detection signal.

The multiple feed detection sensor portion 21*b* can detect that separation by the separation rollers 153 has not been performed appropriately, and is installed on the downstream side of the separation rollers 153 in the housing 10. If two or more documents Sh are detected (so-called multiple feed occurs), the multiple feed detection sensor portion 21*b* outputs a predetermined detection signal. In this embodiment, a sensor including an ultrasonic transmission element and an ultrasonic reception element is used to detect multiple feed by attenuation of an ultrasonic wave by the documents Sh.

The first document detection sensor portion 21*c* is installed on the upstream side of the roller pair 159*a* and on the downstream side of the multiple feed detection sensor portion 21*b* in the housing 10, is configured to detect that the leading edge of document Sh has reached the feeding rollers 151, and outputs, if the document Sh has been detected, a predetermined detection signal. In this embodiment, an optical sensor is used to detect, when light is shielded by the document Sh, that the document Sh has reached.

The second document detection sensor portion 21*d* is installed on the downstream side of the roller pair 159*a* and on the upstream side of the reading unit 16 in the housing 10, is configured to detect that the leading edge of the document Sh has reached the roller pair 159*a* or the trailing edge of the document Sh has passed through the roller pair 159*a*, and outputs, if the document Sh has been detected, a predetermined detection signal. In this embodiment, an optical sensor is used to detect, when light is shielded by the document Sh, that the document Sh has reached.

Note that the present invention is not limited to the above-described arrangement, and any known sensor can be used for each of the document stacking sensor portion 21*a*, the multiple feed detection sensor portion 21*b*, the first document detection sensor portion 21*c*, and the second document detection sensor portion 21*d*. For example, a lever type sensor can be used as the document stacking sensor portion 21*a*. For example, an optical sensor, an ultrasonic sensor, or the like can be used as each of the multiple feed detection sensor portion 21*b*, the first document detection sensor portion 21*c*, and the second document detection sensor portion 21*d*. Each of the multiple feed detection sensor portion 21*b*, the first document detection sensor portion 21*c*, and the second document detection sensor portion 21*d* may be formed by a transmission sensor and a reception sensor.

The operation input unit 22 is an operation panel used by a user to input an image reading instruction, and may be installed in any portion of the exterior of the housing 10. The operation input unit 22 may further have the function of a display unit. In this embodiment, a touch panel display can typically be used as the operation input unit 22.

The control unit 23 includes a CPU (Central Processing Unit) 231, a memory 232, and a communication interface 233. The CPU 231 reads an image by reading out a predetermined program from another memory (a nonvolatile memory such as a ROM) (not shown), loading it into the memory 232 (a volatile memory such as a RAM), and executing each step (to be described later) (see FIG. 7). Furthermore, the CPU 231 can receive the input signal of the operation input unit 22 or the detection signal of the document stacking sensor portion 21*a* or the like via the communication interface 233, and can receive another input signal from an external apparatus (not shown).

As another embodiment, the control unit 23 may be formed by a semiconductor device such as an ASIC (Application-Specific Integrated Circuit). That is, the function of the control unit 23 may be implemented by either hardware or software. The control unit 23 may be expressed as a driving control unit, an image reading control unit, a document receiving control unit, or the like in accordance with the function, and may be individually provided in correspondence with each function.

With this arrangement, the control unit 23 controls driving of each of the above-described elements so as to implement image reading of the document Sh (and reception and discharge of the document Sh) based on the input signal of the operation input unit 22, the detection signal of the document stacking sensor portion 21*a* or the like, and the like. Although details will be described later, for example, the control unit 23 can control the power transmission mechanism 19 to drive the feeding rollers 151 after the start of pivot of the arm portion 171 from the position P1.

As shown in FIG. 2, the document stopper 173 and the feeding roller 151 are provided side by side. The plurality of document stoppers 173 and the plurality of feeding rollers 151 are preferably provided side by side. In this embodiment, the document stoppers 173 are provided integrally in the arm portion 171 at three positions in the central portion, the left portion, and the right portion to be pivotable. The feeding rollers 151 are provided at two positions between the central portion and the left portion and between the central portion and the right portion. With this arrangement, as shown in FIG. 3, on the side view, the position where the document stopper 173 in the standing posture and the feeding roller 151 overlap each other can be moved. Thus, the document stoppers 173 in the standing posture are located on the upstream side of the feeding rollers 151, the leading edge of a document bundle including the documents Sh before the start of feed of the documents Sh can be aligned to the document stoppers 173, and the movement of the document at the time of receiving the document Sh can be stabilized, thereby appropriately suppressing the reception of the document Sh.

Figure 7:
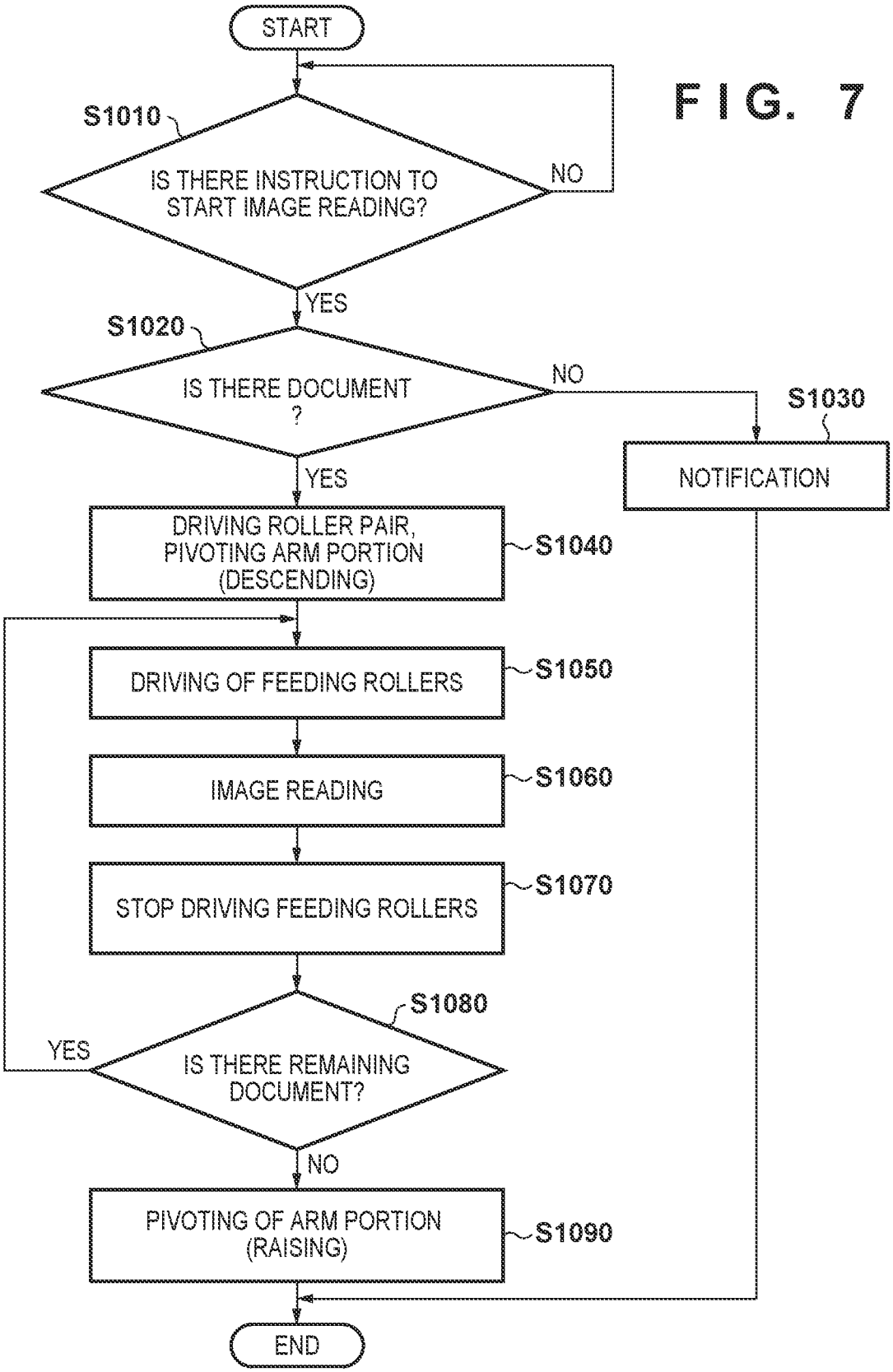
FIG. 7 is a flowchart illustrating a method of executing image reading of a document.

FIG. 7 is a flowchart illustrating a method of executing image reading of the document Sh. This flowchart is mainly executed by the control unit 23. An overview of the flowchart is to prevent damage to the document Sh by driving the feeding rollers 151 after the start of pivot of the arm portion 171 from the position P1.

In step S1010 (to be simply referred to as "S1010" hereinafter) (the same applied to other steps (to be described later)), the presence/absence of an image reading start instruction is determined. If an image reading start instruction is issued, the process advances to S1020; otherwise, the process returns to S1010.

In S1020, the presence/absence of the document Sh on the stack tray 13 is determined based on the detection signal of the document stacking sensor portion 21*a*. If there exists the document Sh on the stack tray 13, the process advances to S1040; otherwise, the process advances to S1030. Note that if there is no document Sh, the determination processing in S1020 may be repeated until a predetermined time elapses, and then the process may advance to S1030 after the predetermined time elapses.

In S1030, a notification that there is no document Sh on the stack tray 13 is output, and the flowchart ends. This notification is made by a touch panel display as the operation input unit 22.

In S1040 and subsequent steps, reception of the document Sh starts on the assumption that there exists the document Sh on the stack tray 13. In S1040, driving of the power source 18*b* for driving the roller pair 159*a* and the like starts, and the arm portion 171 pivots from the position P1 to the position P2 accordingly. This switches the document stoppers 173 from the standing posture to the tilting posture. At this time, as described above, each document stopper 173 is locked by the holder member 154 while being biased by the biasing portion 20*c*, and is thus appropriately switched from the standing posture to the tilting posture. This switches the receiving port 14 from the closed state to the open state, thereby making it possible to receive the document Sh.

Note that in a state in which the pressing portions 172 move from the position P1 toward the position P2, the document stoppers 173 function as the conveyance surface of the document Sh. At this time, the posture of each document stopper 173 is decided when the document stopper 173 is in slidable contact with a lock portion 154*a* of the holder member 154, and a slide contact surface 154*b* of the lock portion 154*a* is formed in an arc shape coaxial to the pivot axis of the separation roller 153. This can keep a constant protrusion amount by which the surface of the separation roller 153 protrudes from the conveyance surface of the document stopper 173 during a process in which the pressing portion 172 moves from the position P1 to the position P2, thereby maintaining a stable sheet feeding state.

As described above, the stack tray 13 is extended to be tilted. With the pivot of the arm portion 171, the document Sh on the stack tray 13 is pressed by the pressing portions 172. The document Sh moves, by its own weight, to a position where it comes into contact with the feeding rollers 151, and is pressed by the pressing portions 172 against the feeding rollers 151.

In S1050, driving of the feeding rollers 151 is started by driving the power source 18*a*. This receives the document Sh from the stack tray 13 through the open receiving port 14.

In S1060, the reading unit 16 starts image reading of the document Sh while conveying the document Sh based on the detection signal output from the second document detection sensor portion 21*d* and indicating that the leading edge of the document Sh has reached. Note that at this time, the first document detection sensor portion 21*c* simultaneously executes jam detection by detecting, for example, whether the document Sh has reached the second document detection sensor portion 21*d* or the like within a predetermined time since the start of driving of the feeding rollers 151.

In S1070, similar to S1060, based on the detection signal output from the second document detection sensor portion 21*d* and indicating that the leading edge of the document Sh has reached, driving of the power source 18*a* is stopped to interrupt (temporarily stop) driving of the feeding rollers 151. That is, if the downstream end portion (leading edge) of the document Sh has reached the second document detection sensor portion 21*d*, the single document Sh has been received appropriately. Thus, the start of reception of the next document Sh is suppressed until image reading and discharge of the document Sh are completed. Note that FIG. 7 shows that S1060 and S1070 are sequentially executed. In fact, S1060 and S1070 may be inversed or executed simultaneously.

In S1080, the image reading is stopped based on the detection signal indicating that the upstream end portion (trailing edge) of the document Sh has passed through the second document detection sensor portion 21*d*, and the presence/absence of the document Sh on the stack tray 13 is determined based on the detection signal of the document stacking sensor portion 21*a*. If there exists the document Sh on the stack tray 13, the process returns to S1050; otherwise, the process advances to S1090. That is, if the document Sh remains on the stack tray 13, S1050 to S1080 are repeatedly executed; otherwise, the process advances to S1090.

In S1090, assuming that there is no document Sh remaining on the stack tray 13, the power source 18*b* is driven in the opposite direction of the feeding direction of the document Sh to cause the arm portion 171 to pivot from the position P2 to the position P1. The document stoppers 173 are accordingly switched from the tilting posture to the standing posture. Thus, the reception of the document Sh is stopped, and the process returns to S1010.

According to this embodiment, each document stopper 173 can pivot between the standing posture in which reception of a document is suppressed and the tilting posture in which reception of a document is permitted. In the standing posture, the document stopper 173 is held by the holding portion 174 and biased by the biasing portion 20*c* to be set in the tilting posture. When receiving the document Sh, the document stoppers 173 pivot to be switched from the standing posture to the tilting posture before driving of the feeding rollers 151, thereby switching the receiving port 14 from the closed state to the open state. It is possible to align the leading edge of a document bundle to the document stoppers 173 before the start of feed of the documents Sh, and stabilize movement at the time of receiving the documents Sh. Furthermore, after the start of feed of the documents Sh, the document stoppers 173 are biased in a direction of retraction from the documents Sh. Therefore, the documents Sh are not pressed by the document stoppers 173. This allows the document Sh to be appropriately received into the apparatus main body without damage (folding, deformation, or the like) caused by interference with the document stoppers 173 in the standing posture, thereby appropriately performing image reading.

As will be described later, by bringing the documents Sh into contact with the document stoppers 173 in an intermediate posture between the standing posture and the tilting posture, the paper separation effect acts on the documents Sh, thereby making it possible to improve the receiving performance of the documents Sh.

As another form, an arrangement in which the control unit 23 performs driving control of pivot of the guide member 131 in the feeding roller cover 130 of the image reading apparatus 1 may be adopted. The pivot of the guide member 131 is performed based on, for example, the power of the power source 18*b*. The guide member 131 pivots so that the placement surface f1 is located above the feeding rollers 151 if the document stoppers 173 are in the standing posture and so that the placement surface f1 is located below the feeding rollers 151 if the document stoppers 173 are in the tilting posture. This can be controlled by the driving direction of the power source 18*b*. For example, it is configured such that the document stoppers 173 are set in the standing posture by reversely driving the power source 18*b* while being pushed up by a cam member (not shown) so that the placement surface f1 of the guide member 131 is located above the feeding rollers 151, and the document stoppers 173 are set in the tilting posture by normally driving the power source 18*b* while the contact with the guide member 131 by the cam member (not shown) is canceled to push down the guide member 131 by the biasing portion 20*d* so that the placement surface f1 of the guide member 131 is located below the feeding rollers 151.

Figure 8:
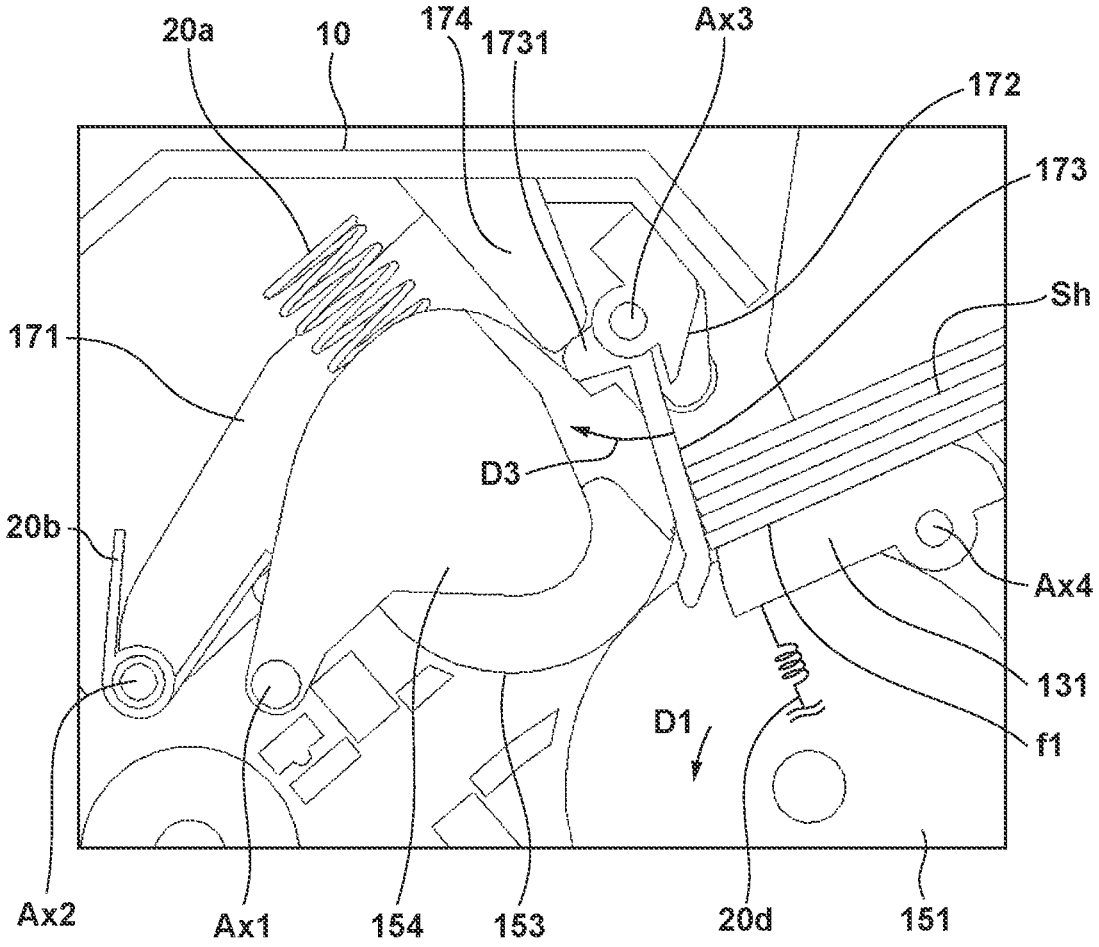
FIG. 8 is a schematic view showing the pivot mode of a guide member.
Figure 9:
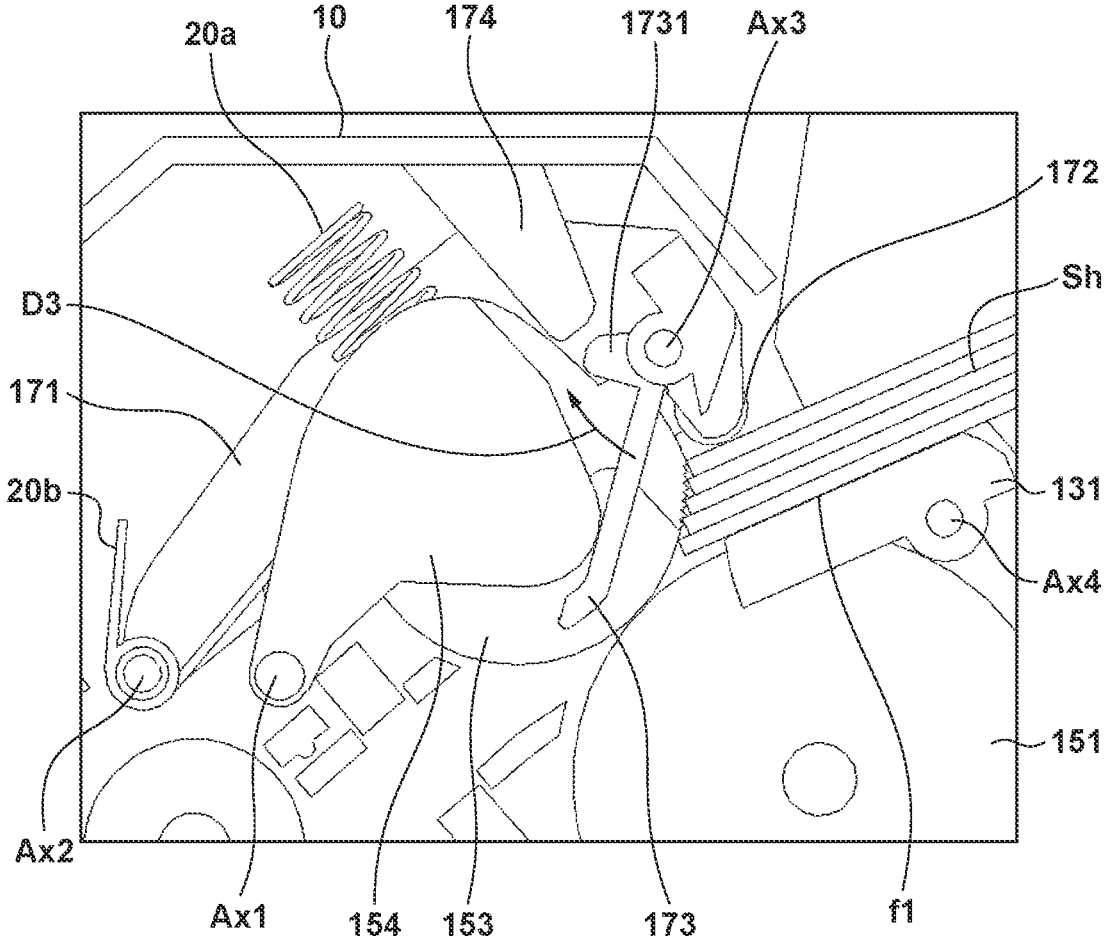
FIG. 9 is a schematic view showing the pivot mode of the guide member.
Figure 10:
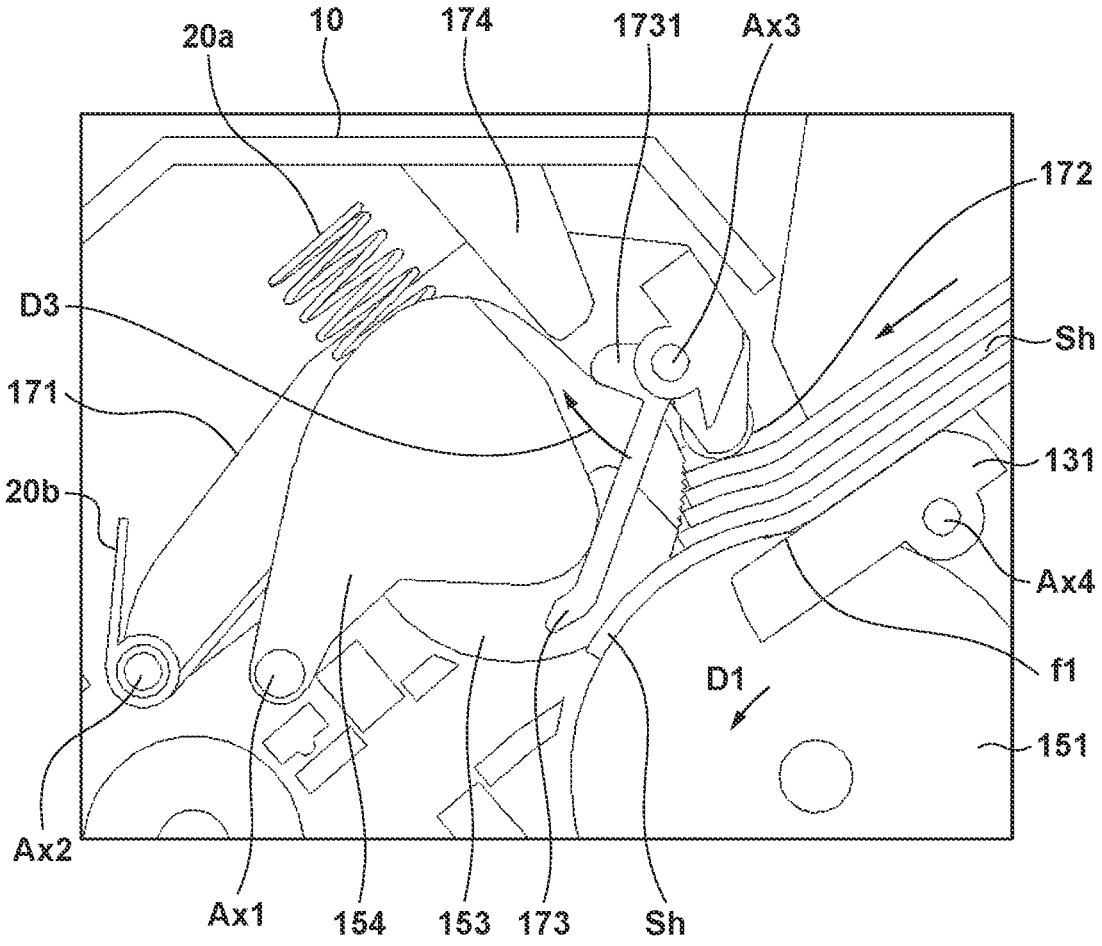
FIG. 10 is a schematic view showing the pivot mode of the guide member.

FIGS. 8 to 10 are schematic views each showing the pivot mode of the guide member 131 when the document stoppers 173 are switched from the standing posture to the tilting posture. Assume that the guide member 131 pivots about a shaft portion A×4. While the document stoppers 173 are in the standing posture, the guide member 131 maintains, by the cam member (not shown) transmitted with the power of the power source 18*b*, a state in which the placement surface f1 is located above the feeding rollers 151 (see FIG. 8). If the arm portion 171 pivots from the position P1 to the position P2, the document stoppers 173 are separated from the holding portion 174 to be tilted by biasing by the biasing portion 20*c*. During this period, the guide member 131 maintains a state in which the placement surface f1 is located above the feeding rollers 151 (see FIG. 9). After that, pressing by the cam member is canceled, and the guide member 131 pivots by the biasing force of the biasing portion 20*d* to a position where the placement surface f1 is located below the feeding rollers 151 (see FIG. 10).

With this arrangement, when receiving the documents Sh, if the document stoppers 173 are in the standing posture (the receiving port 14 is in the closed state), the documents Sh on the stack tray 13 do not come into contact with the feeding rollers 151, and are thus not caught by the surfaces of the feeding rollers 151 when stacked on the stack tray 13, thereby improving the stack operability. The document stoppers 173 align the leading edge of a document bundle including the documents Sh stacked on the stack tray 13, and it is thus possible to stabilize the movement of the document at the time of receiving the document. Since the document stoppers 173 are biased in the direction D3 in FIG. 8, the document Sh is not unexpectedly damaged due to interference with the document stoppers 173. If the document stoppers 173 are in the tilting posture (the receiving port 14 is in the open state), the documents Sh on the stack tray 13 come into contact with the feeding rollers 151 and are appropriately received from the receiving port 14 into the apparatus main body. This can receive the documents Sh more appropriately.

Note that in this embodiment, driving of the feeding rollers 151 starts after the document stoppers 173 are set in the tilting posture (the receiving port 14 is set in the open state). However, the present invention is not limited to this, and it is only necessary to avoid a situation in which while there is no gap, between the document stoppers 173 and the separation rollers 153, through which the document Sh can pass, the documents Sh come into contact with the feeding rollers 151 in the driving state, and thus abut against the document stoppers 173. Therefore, it is possible to adjust the timing of starting driving without departing from the scope.

In this example, the control unit 23 drives the power source 18*b* to cause the guide member 131 to pivot. As still another embodiment, the guide member 131 may be mechanically configured to move in synchronism with the pivot of the arm portion 171. For example, the guide member 131 may be linked with the arm portion by a link arrangement, and may pivot together with the arm portion 171 when the arm portion 171 pivots from the position P1 to the position P2. Furthermore, each driving unit may be configured to be driven using a different power source. The power sources 18*a* and 18*b* may be formed by the same power source. In this case, a driving transmission timing to each unit may be mechanically shifted using a cam or the like.

Note that this example has explained the arrangement in which the guide member 131 is pushed up by the cam member (not shown) to a position above the feeding rollers 151, and is pushed down to a position below the feeding rollers 151 by the biasing force of the biasing portion 20*d* when pressing by the cam member is canceled, and vice versa. That is, an arrangement in which the guide member 131 is pushed up to a position above the feeding rollers 151 by the biasing force of the biasing portion 20*d* and is pushed down to a position below the feeding rollers 151 by the lock of the cam member may be adopted.

If the plurality of documents Sh stacked on the stack tray 13 are received from the receiving port 14 into the apparatus main body in an arbitrary order, the posture of the plurality of stacked documents Sh may collapse. This may cause inappropriate reception, conveyance, image reading, and discharge of the documents Sh.

To cope with this, in order to maintain the proper posture of the plurality of stacked documents Sh, it can generally be required to sequentially receive the plurality of documents Sh from the receiving port 14 into the apparatus main body from one side of the stacking direction. In other words, it is preferable that the documents Sh to be received are properly separated and received one by one. In this embodiment, the plurality of documents Sh are preferably received into the apparatus main body sequentially from the document closest to the feeding rollers 151.

Figure 17:
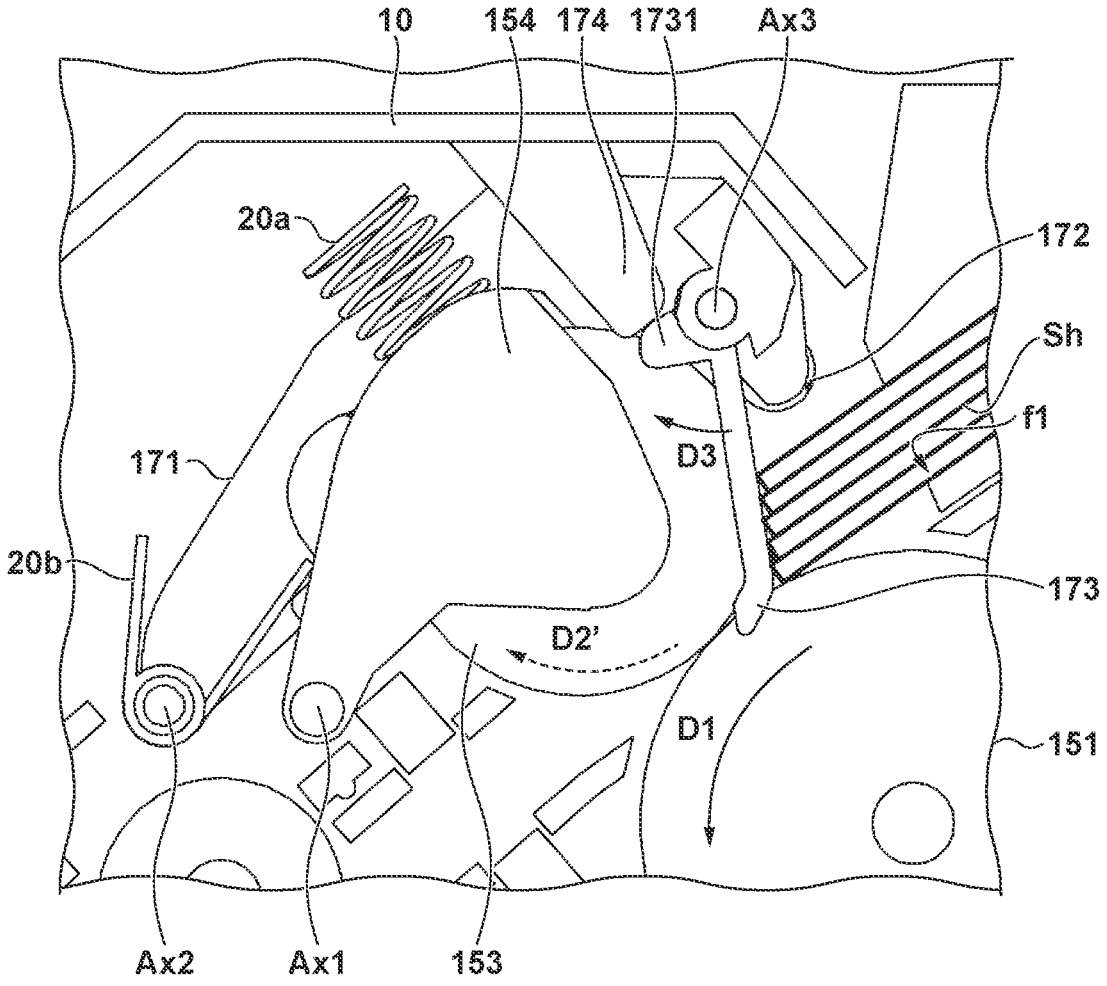
FIG. 17 is a schematic side view showing the operation mode of a document stopper at the time of receiving a document.

As exemplified in FIG. 17, in this embodiment, at the start of receiving the documents Sh, the downstream end portions of the plurality of documents Sh on the stack tray 13 are brought into contact with the document stoppers 173 in the intermediate posture as a posture between the standing posture and the tilting posture. This allows the document stoppers 173 in the intermediate posture to separate the downstream end portions of the plurality of documents Sh on the stack tray 13, and thus the plurality of documents Sh can appropriately be received into the apparatus main body sequentially from the document closest to the feeding rollers 151. Note that separation of the documents Sh by the document stoppers 173 indicates a state in which the downstream end portion of the document Sh generally located on the side of the feeding rollers 151 is located on the downstream side of the downstream end portion of the document Sh stacked on that document Sh.

In this embodiment, the pivot shaft A×3 of each document stopper 173 is provided on the opposite side (above the apparatus) of the feeding roller 151 in the document stopper 173. Therefore, in the intermediate posture, the document stopper 173 is located on the upstream side as it is closer to the pivot shaft A×3, and is located on the downstream side as it is farther away from the pivot shaft A×3. Thus, the plurality of documents Sh come into contact with the document stoppers 173 in the intermediate posture so that the downstream end portions of the documents Sh are located on the downstream side sequentially from the document close to the feeding rollers 151. In other words, the documents Sh are shifted to the upstream side sequentially from the document close to the feeding rollers 151 in the conveyance direction. The shift amount typically depends on the contact angle with the document stoppers 173 and the thickness of the document Sh. In this way, the plurality of documents Sh come into contact with the feeding rollers 151 to be appropriately received into the apparatus main body sequentially from the document closest to the feeding rollers 151.

In this embodiment, the pivot speed of the document stopper 173 from the standing posture to the tilting posture is lower than the conveyance speed of the document Sh by the feeding rollers 151. More specifically, the gear and cam of a driving transmission portion to which driving transmission is performed by the power source 18*b* to switch the document stoppers 173 from the standing posture to the tilting posture are adjusted so that the document stoppers 173 pivot such that a speed component in the conveyance direction, of the pivot speed of the distal end portions of the document stoppers 173, is lower than the conveyance speed of the document Sh by the feeding rollers 151. This allows the plurality of documents Sh on the stack tray 13 to appropriately come into contact with the document stoppers 173 in the intermediate posture. Note that even if the power sources 18*a* and 18*b* are formed by a single power source, the gear and cam are similarly adjusted.

The documents Sh are brought into contact with the document stoppers 173 in the intermediate posture so as to implement the above shift. For example, the documents are brought into contact with the document stoppers 173 when the angle (acute angle) between the placement surface f1 and the contact surface of each document stopper 173 in the intermediate posture falls within the range from 10° to 80°, preferably the range from 30° to 60°, and more preferably the range from 40° to 50°.

As described above, the document stoppers 173 are biased by the biasing portion 20*c* to be set in the tilting posture. Therefore, when the plurality of documents Sh are brought into contact with the document stoppers 173, no excessive reaction force is applied to the plurality of documents Sh and thus the plurality of documents Sh are not damaged (folded or deformed) by such reaction force. Thus, the plurality of documents Sh can be appropriately, sequentially received into the apparatus main body by the feeding rollers 151.

The pivot speed of the document stoppers 173 and the conveyance speed of the document Sh by the feeding rollers 151 are constant in this embodiment but may be variable. For example, if the driving force by the power source 18*b* is constant, in a state in which the document stoppers 173 pivot toward the tilting posture, the pivot speed of the document stoppers 173 may satisfy the above-described relationship until the upstream end surfaces (the surfaces with which the document Sh comes into contact) of the document stoppers 173 move to a position on the downstream side of the roller surfaces of the separation rollers 153, and the document stoppers 173 may pivot at a higher pivot speed thereafter.

As another embodiment, alternatively/additionally, during the pivot of the document stoppers 173 from the standing posture to the tilting posture, the pivot may be temporarily stopped, and the downstream end portions of the plurality of documents Sh may be brought into contact with the document stoppers 173. As still another embodiment, alternatively/additionally, the timing of starting pivot of the document stoppers 173 and the timing of starting driving of the feeding rollers 151 may be adjusted so that the downstream end portions of the plurality of documents Sh are brought into contact with the document stoppers 173 in the intermediate posture.

Some modifications may be made to the above-described embodiment without departing from the scope. For example, before conveyance of the document Sh or between conveyance of the given document Sh and conveyance of the next document Sh, pivot of the document stoppers 173 may be performed once, twice, or more. The pivot at this time may be smaller than a movable region between the standing posture and the tilting posture, thereby making it possible to reduce damage to the document Sh. This operation may be performed for the documents Sh difficult to be separated from each other, may be executed when, for example, a specific mode is selected as a reading mode of the document Sh by user setting, or may be executed only when execution of such pivot operation of the document stoppers 173 is selected.

A power source that generates power for pivot of the feeding rollers 151 and a power source that generates power for pivot of the document stoppers 173 can be separately installed, and are individually driven. In this case, as described above, after the document stoppers 173 are set in the intermediate posture, it is easy to start driving of the feeding rollers 151, and it is possible to omit temporary stop of the pivot of the document stoppers 173. The same applies even if the timing of starting pivot of the document stoppers 173 and the timing of starting driving of the feeding rollers 151 are adjusted.

Second Embodiment

The second embodiment is different from the above-described first embodiment in that a stack tray 13 of an image reading apparatus 1 is configured to lock document stoppers 173 in the standing posture.

Figure 11:
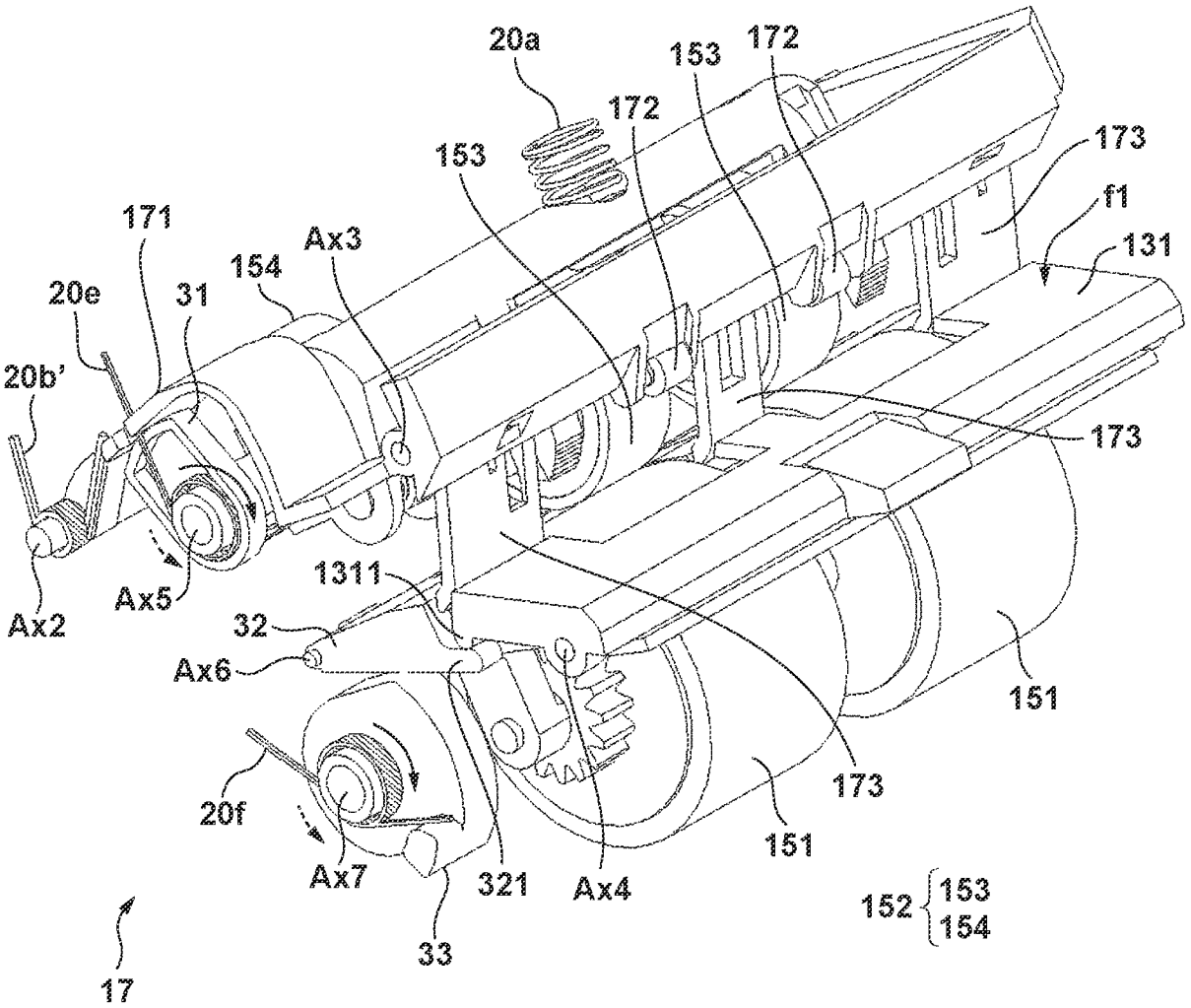
FIG. 11 is a perspective view of a document receiving mechanism.
Figure 12:
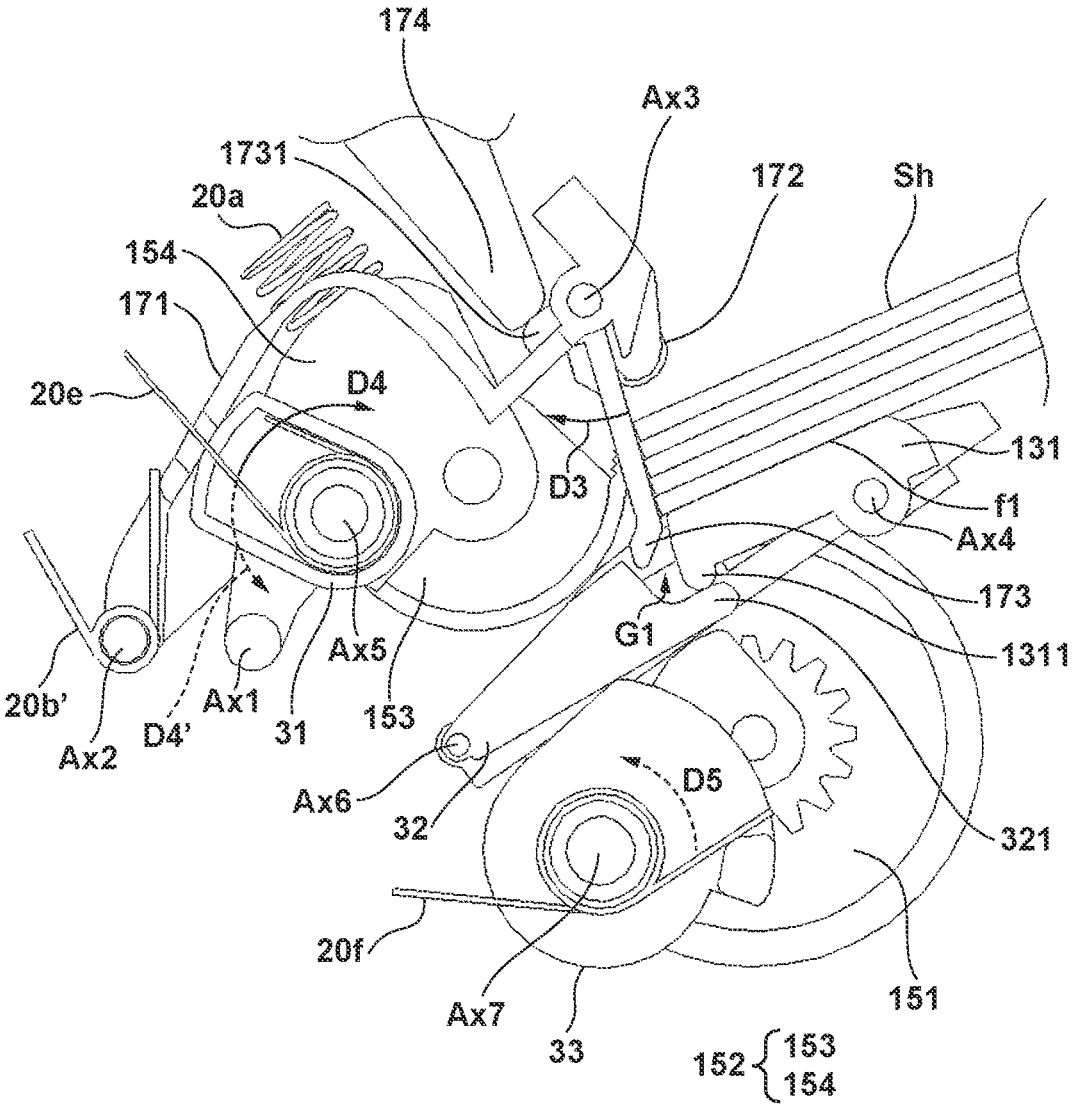
FIG. 12 is a schematic side view showing the operation mode of the document receiving mechanism.
Figure 13:
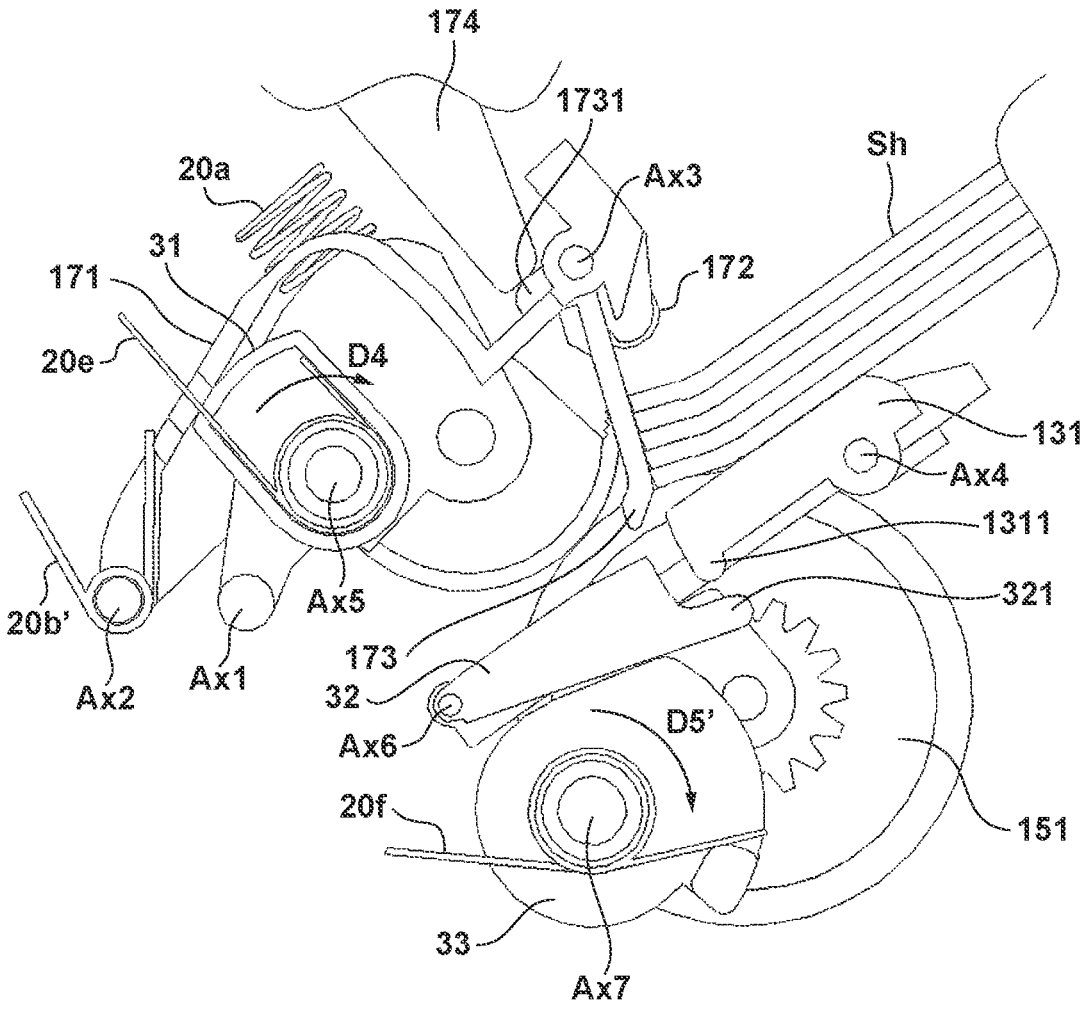
FIG. 13 is a schematic side view showing the operation mode of the document receiving mechanism.

FIG. 11 is a perspective view of a document receiving mechanism 17 according to this embodiment. FIGS. 12 to 16 are schematic side views each showing the operation mode of the document receiving mechanism 17. In this embodiment, an arm portion 171 is biased by a biasing portion 20*b*' in a direction of moving close to feeding rollers 151. In this embodiment, the image reading apparatus 1 further includes an arm support portion 31, a pivot member 32, a pivot member support portion 33, and biasing portions 20*e* and 20*f*.

The arm support portion 31 is installed, in a housing 10, to be pivotable about a shaft portion A×5. The arm support portion 31 is biased by the biasing portion 20*e* in a direction D4. Furthermore, the arm support portion 31 receives the power of a power source 18*b* to pivot in a direction D4', and is thus held such that the arm portion 171 can be maintained at a position P1. When the arm portion 171 is at the position P1, the document stoppers 173 are in the standing posture. When the arm portion 171 is at a position P2, the document stoppers 173 are in the tilting posture.

The pivot member 32 is attached to a feeding roller cover 130 (see FIG. 2) to be pivotable about a shaft portion A×6. The pivot member 32 includes an extending portion 321, and a contact portion 1311 in contact with the extending portion 321 is provided in a guide member 131 of the feeding roller cover 130.

The pivot member support portion 33 supports the pivot member 32 from below, and is installed to be pivotable about a shaft portion A×1 with respect to the housing 10. The pivot member support portion 33 is biased by the biasing portion 20*f* in a direction D5'. The pivot member support portion 33 receives the power of the power source 18*b* to pivot in a direction D5, thereby supporting the pivot member 32 so that the extending portion 321 comes into contact with the contact portion 1311. In this embodiment, the guide member 131 is biased by a biasing portion (not shown) in a direction in which a placement surface f1 moves away from the center side of a conveyance path, and the extending portion 321 comes into contact with the contact portion 1311, thereby holding the guide member 131 at a position shown in FIG. 12. Note that it may be configured so that the placement surface f1 moves away from the center side of the conveyance path by the weight of the document or the guide member 131.

With this arrangement, the pivot member 32 forms a gap G1, with the guide member 131, in which the document stoppers 173 in the standing posture can be fitted. That is, while the arm portion 171 is at the position P1, the document stoppers 173 are held by being fitted in the edge portion forming the gap G1 (see FIG. 12). From this viewpoint, it can be said that the gap G1 functions as a second lock portion for locking the document stoppers 173 in the standing posture. With this arrangement, it is possible to prevent distortion of the document stoppers 173 caused by the load of the documents Sh on the stack tray 13, and prevent a situation in which the document stoppers 173 are unexpectedly damaged and a situation in which sheet feeding starts in a state in which the leading edges of the documents are not brought into contact with separation rollers 153 and are not aligned.

On the other hand, when the power of the power source 18*b* transmitted to the arm support portion 31 is stopped, if the arm support portion 31 pivots in the direction D4 to cause the arm portion 171 to pivot from the position P1 to the position P2 by biasing of the biasing portion 20*b*', the guide member 131 pivots, almost simultaneously with that operation or before that operation, until the placement surface f1 is located below the feeding rollers 151. The guide member 131 pivots as a result of pivot of the pivot member support portion 33 in the direction D5' to cause the pivot member 32 to pivot in a direction in which the extending portion 321 retracts from the contact portion 1311 by a biasing portion (not shown) (see FIG. 13). This cancels holding of the document stoppers 173 in the gap G1, and thus the document stoppers 173 can be tilted by biasing of a biasing portion 20*c*.

Figure 14:
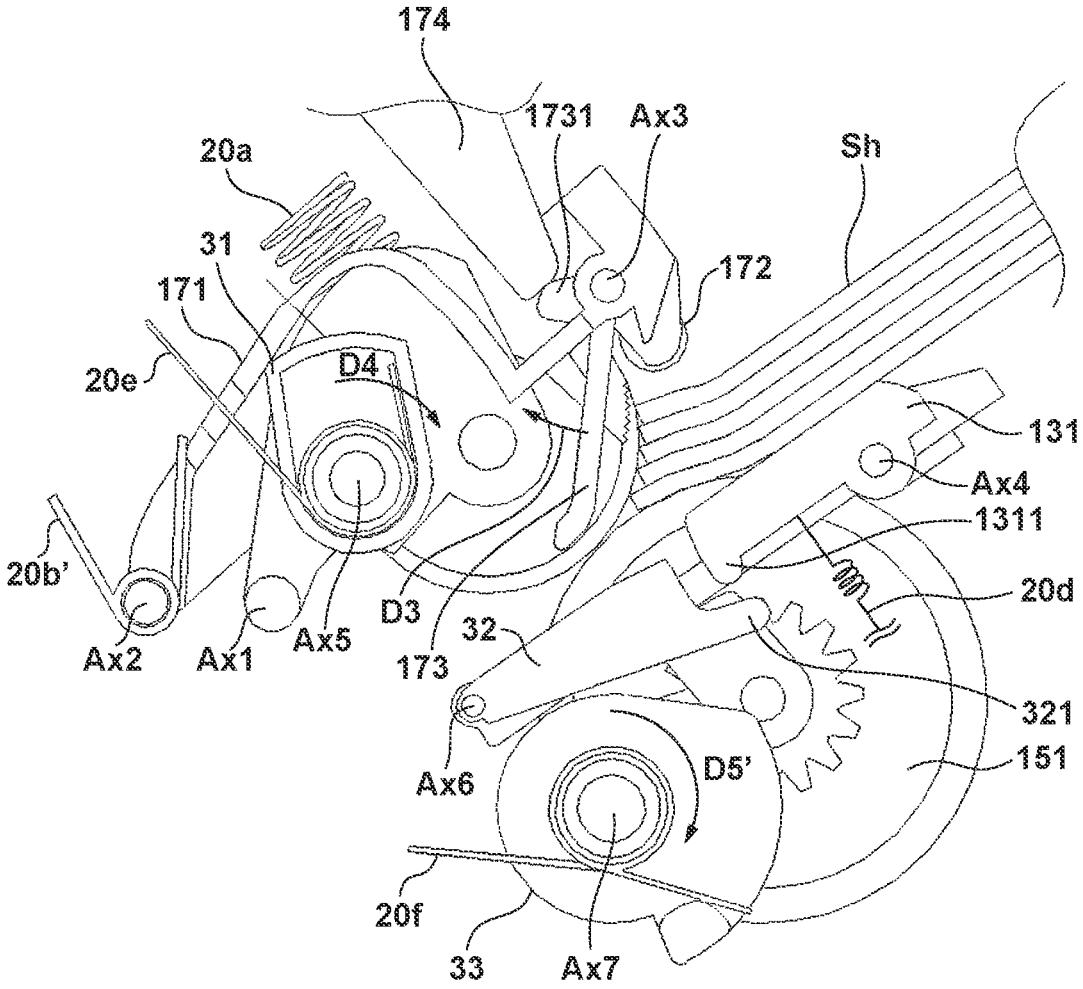
FIG. 14 is a schematic side view showing the operation mode of the document receiving mechanism.
Figure 15:
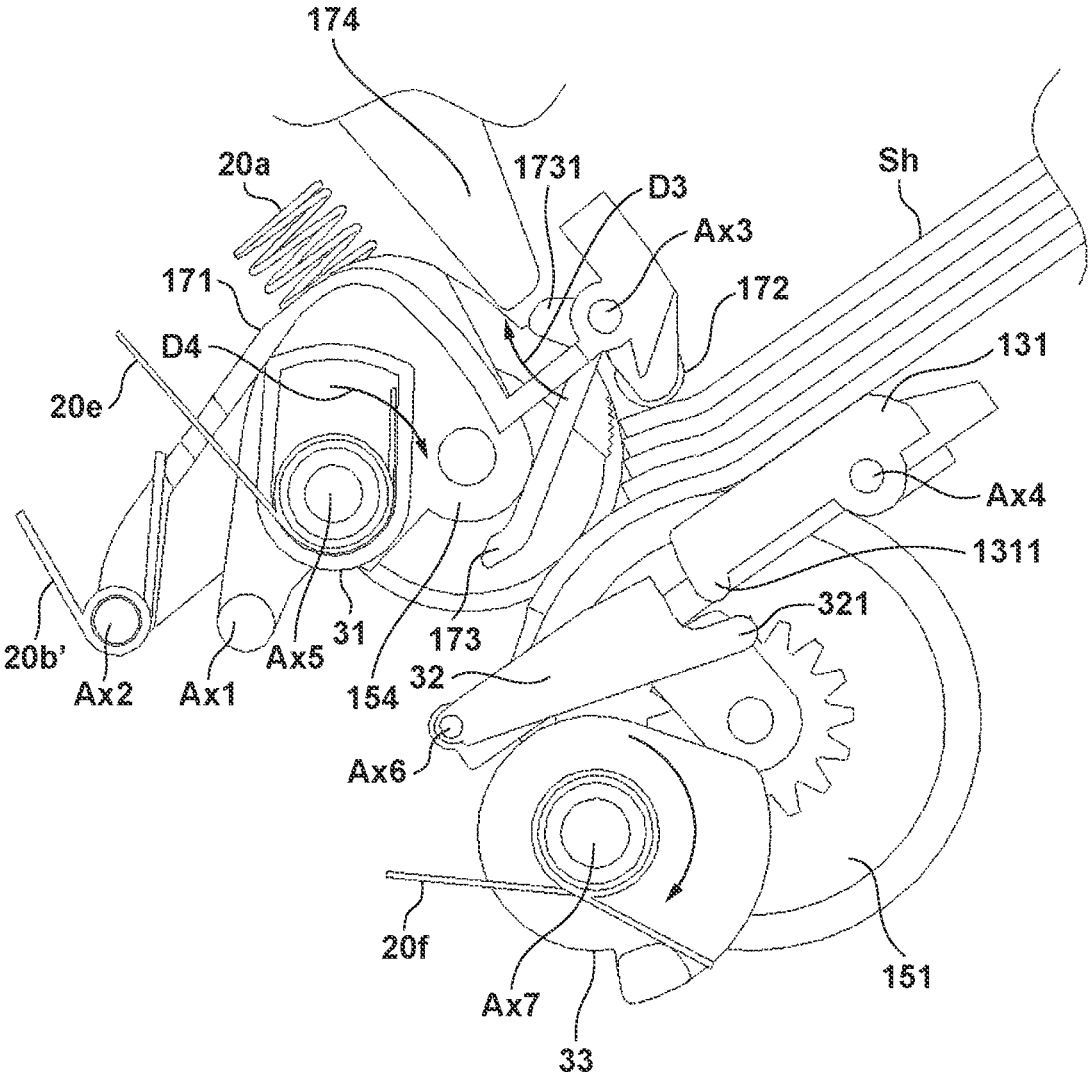
FIG. 15 is a schematic side view showing the operation mode of the document receiving mechanism.
Figure 16:
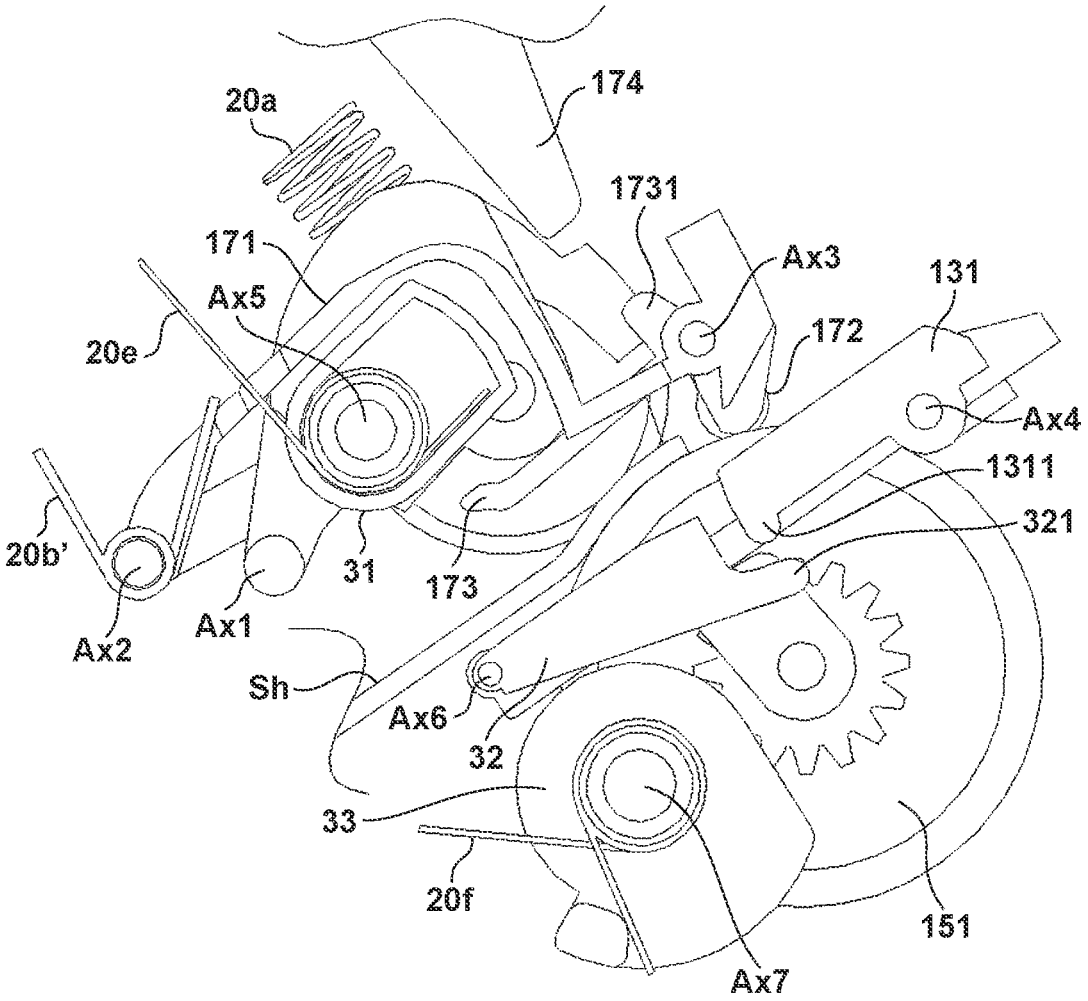
FIG. 16 is a schematic side view showing the operation mode of the document receiving mechanism.

After that, the arm support portion 31 further pivots in the direction D4 to cause the arm portion 171 to pivot (see FIG. 14). Accordingly, when the lock portion 1731 is separated from a holding portion 174 and holding by the holding portion 174 is canceled, the document stoppers 173 are switched from the standing posture to the tilting posture, and then a pressing portion 172 presses the documents Sh (see FIG. 15). After that, in this state, the documents Sh are received (see FIG. 16).

According to this embodiment, in addition to obtaining of the same effect as in the first embodiment, it is possible to prevent unexceptional damage to the document stoppers 173, and also prevent the leading edges of the documents from coming into contact with the feeding rollers 151 and the separation rollers 153 when setting the documents on the stack tray 13. In addition, in this embodiment as well, at the start of receiving the documents Sh, the downstream end portions of the plurality of documents Sh on the stack tray 13 are preferably brought into contact with the document stoppers 173 in the intermediate posture. This makes it possible to appropriately receive the plurality of documents Sh into the apparatus main body sequentially from the document closest to the feeding rollers 151.

Third Embodiment

Figure 18:
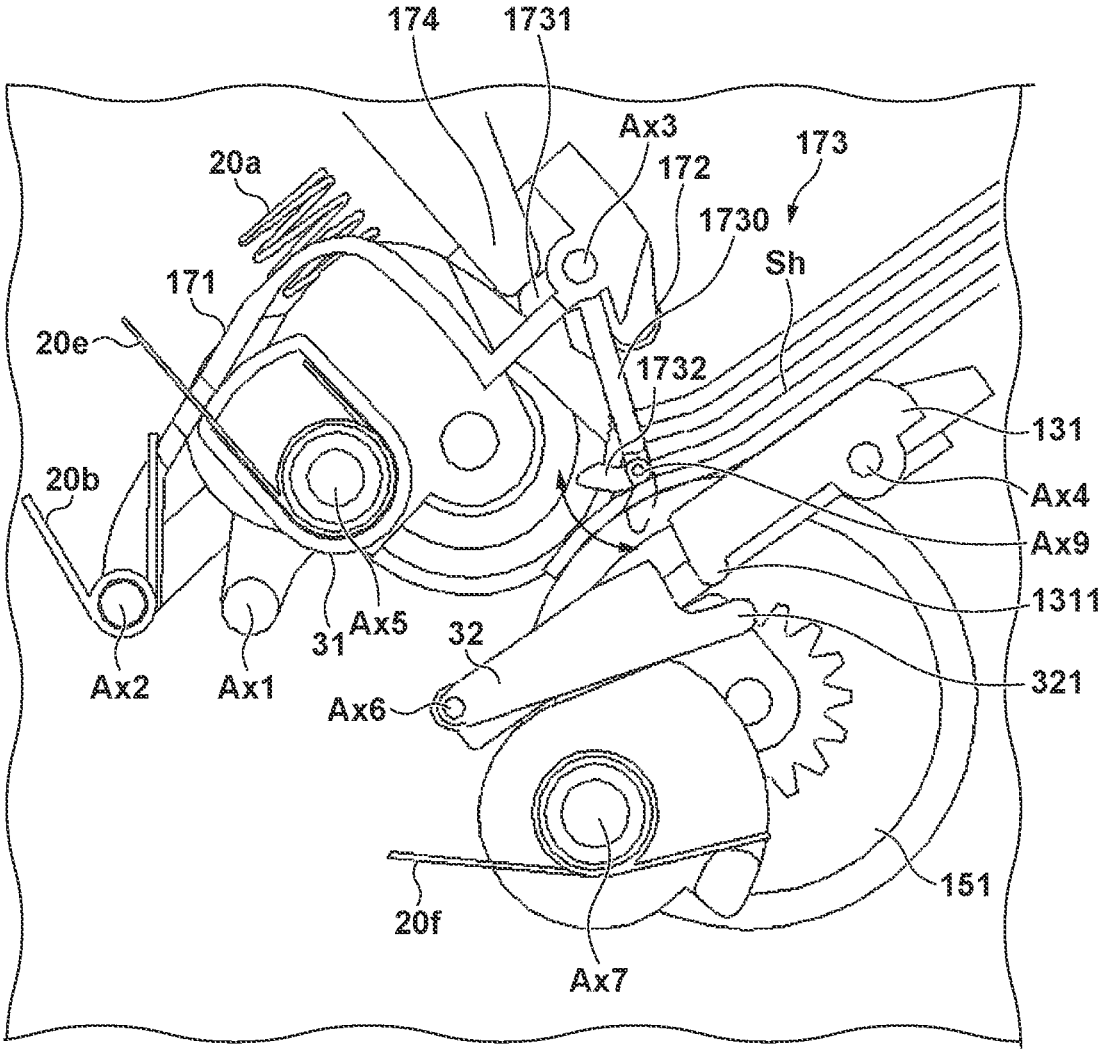
FIG. 18 is a schematic side view showing the operation mode of a document stopper at the time of receiving a document.

As exemplified in FIG. 18, a document stopper 173 may include a stopper main body portion 1730 and a rotary distal end portion 1732. The rotary distal end portion 1732 can be provided to be pivotable about a shaft portion A×9 as a rotation axis in a distal end portion on the side of feeding rollers 151, and the size of the rotary distal end portion 1732 can be decided to permit reception of one document Sh.

The rotary distal end portion 1732 pivots on the downstream side before or almost simultaneously with pivot of the stopper main body portion 1730. Thus, before the plurality of documents Sh on a stack tray 13 come into contact with the document stoppers 173 in the intermediate posture or almost simultaneously with the contact, only one document closest to the feeding rollers 151 among the plurality of documents Sh is received into the apparatus main body.

With this arrangement, when the plurality of documents Sh on the stack tray 13 come into contact with the document stoppers 173 in the intermediate posture, the downstream end portions of the plurality of documents Sh are set to be located on the downstream side sequentially from the document closest to the feeding rollers 151, and one document Sh can be received. That is, the above contact can set the postures of the plurality of documents Sh on the stack tray 13 to the proper postures, and start to receive one document Sh. Therefore, this arrangement is advantageous in improving the reception efficiency of the documents Sh.

In each of the above-described embodiments, the power sources 18*a* and 18*b* have been explained as different power sources but may be formed by one power source. In this case, a clutch that interrupts transmission of driving power, a delay mechanism for shifting a driving timing by delaying driving transmission, and the like are provided in a driving transmission path from the power source to each roller or the like.

Others

In each of the embodiments, the name of each element is expressed based on the main function but the function described in the embodiment may be a sub-function. The present invention is not strictly limited to this. This expression can be replaced by a similar expression. To the same effect, a term "unit or portion" may be replaced by "component", "member", "structure", "assembly", or the like, or may be omitted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-141618, filed Aug. 31, 2021, and Japanese Patent Application No. 2021-141609, filed Aug. 31, 2021, which are hereby incorporated by reference herein in their entirety.

What is claimed is:

1. A document receiving apparatus comprising:

a receiving port configured to receive a document into an apparatus main body;

a pressing portion configured to press the document to be received into the receiving port;

a document stopper configured to be pivotable between a first posture in which reception of the document is suppressed and a second posture in which the reception is permitted;

a holding portion configured to hold the document stopper in the first posture;

a biasing portion configured to bias the document stopper held in the first posture to be set in the second posture; and an arm portion configured to pivotably support the document stopper while supporting the pressing portion, and to be pivotable between a first position at which the pressing portion is separated from the document and a second position at which the pressing portion presses the document.

2. The apparatus according to claim 1, wherein if the arm portion is at the first position, the holding portion holds the document stopper in the first posture.

3. The apparatus according to claim 2, wherein the document stopper includes a lock portion configured to be locked in the holding portion so that the document stopper is held in the first posture while the arm portion is at the first position.

4. The apparatus according to claim 1, wherein the pressing portion is a driven roller.

5. The apparatus according to claim 1, further comprising a feeding roller provided on an opposite side of the pressing portion with respect to the document to be received into the receiving port.

6. The apparatus according to claim 5, further comprising a separation roller configured to sandwich the document together with the feeding roller.

7. The apparatus according to claim 6, further comprising a holder member configured to rotatably hold the separation roller, wherein the holder member locks the document stopper, in the second posture, biased by the biasing portion.

8. The apparatus according to claim 7, wherein the holder member includes a lock portion configured to lock the document stopper, and the lock portion includes a slide contact surface having an arc shape coaxial to a rotation axis of the separation roller.

9. The apparatus according to claim 7, wherein the separation roller and the holder member are swingably held by the apparatus main body, and the separation roller is biased to the feeding roller by a second biasing portion provided in the holder member.

10. The apparatus according to claim 5, further comprising:

a conveyance roller provided on a downstream side of the feeding roller; and a power source configured to generate power for pivot of the arm portion and driving of the conveyance roller.

11. The apparatus according to claim 10, further comprising:

a power transmission mechanism arranged in a path between the power source and at least one of the arm portion and the conveyance roller; and a control unit configured to control the power transmission mechanism to drive the feeding roller after a start of pivot of the arm portion from the first position.

12. The apparatus according to claim 5, wherein the document stopper and the feeding roller are arranged side by side, and when viewed in an axial direction of the feeding roller, the document stopper in the first posture and the feeding roller overlap each other.

13. The apparatus according to claim 12, wherein a plurality of document stoppers and a plurality of feeding rollers are arranged side by side.

14. The apparatus according to claim 5, further comprising a guide member configured to form a placement surface on which the document to be received into the receiving port can be placed, wherein the placement surface can pivot from a position above the feeding roller to a position below the feeding roller when viewed in an axial direction of the feeding roller.

15. The apparatus according to claim 14, wherein if the document stopper is in the first posture, the guide member pivots so that the placement surface is located above the feeding roller, and if the document stopper is in the second posture, the guide member pivots so that the placement surface is located below the feeding roller.

16. The apparatus according to claim 5, wherein the feeding roller starts to drive after the document stopper enters the second posture.

17. The apparatus according to claim 1, wherein the document is one of a plurality of documents, and the receiving port receives the document into the apparatus main body from a stack tray on which the plurality of documents can be stacked, the document receiving apparatus further includes:

a feeding roller provided near the receiving port so as to receive the document thereto; and a control unit configured to pivot the document stopper to be set from the first posture to the second posture and receive the document from the receiving port, and the control unit performs a control such that:

the document stopper moves from the first posture to the second posture with a speed slower than that of the document conveyed by the conveyance roller; and the document stopper is in contact with downstream end portions of the plurality of documents while the document stopper is in an intermediate posture between the first posture and the second posture.

* * * * *